US006312077B1

(12) United States Patent
Araki

(10) Patent No.: US 6,312,077 B1
(45) Date of Patent: Nov. 6, 2001

(54) INK JET PRINTER AND INK JET PRINTING METHOD

(75) Inventor: Masatoshi Araki, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/448,218

(22) Filed: Nov. 23, 1999

(30) Foreign Application Priority Data

Nov. 25, 1998 (JP) ..... 10-334771

(51) Int. Cl.[7] ..... B41J 29/38; B41J 2/04; B41J 2/045

(52) U.S. Cl. ..... 347/11; 347/54; 347/68; 347/70

(58) Field of Search ..... 347/11, 54, 10, 347/68, 70, 71

(56) References Cited

U.S. PATENT DOCUMENTS 5,933,168 * 8/1999 Sakai ..... 347/70

FOREIGN PATENT DOCUMENTS

| | | |
|---|---|---|
| 0580154 | 1/1994 | (EP) . |
| 0700783 | 3/1996 | (EP) . |
| 0765750 | 4/1997 | (EP) . |
| 55-17589 | 2/1980 | (JP) . |
| 59-133067 | 7/1984 | (JP) . |
| 4-36071 | 6/1992 | (JP) . |
| 10-250061 | 9/1998 | (JP) . |
| 10-286961 | 10/1998 | (JP) . |
| 10-291310 | 11/1998 | (JP) . |

OTHER PUBLICATIONS

European Search Report issued Sep. 11, 2000 EP 99123426 in a related application (in English).

Patent Abstracts of Japan, vol. 014, No. 478 (M–1036), Oct. 18, 1990 & JP 02 192947 A (Fuji Electric Co Ltd), Jul. 30, 1990 *abstract; figures 9–11*.

Patent Abstracts of Japan, vol. 009, No. 034 (M–357), Feb. 14, 1985 & JP 59–176060 A (Epuson KK), Oct. 5, 1984 *abstract; figure 8*.

Patent Abstracts of Japan, vol. 1997, No. 10, Oct. 31, 1997 & JP 09–141851 A (Seiko Epson Corp), Jun. 3, 1997 *abstract*.

* cited by examiner

*Primary Examiner*—N. Le
*Assistant Examiner*—Shih-wen Hsieh
(74) *Attorney, Agent, or Firm*—Ostrolenk, Faber, Gerb & Soffen, LLP

(57) ABSTRACT

In the ink jet printer, a pressure generation chamber 11 is expanded in a stepped manner, which enables a high speed discharge of a very small ink droplet. Prior to the ink discharge, the pressure generation chamber is contracted so as to enable a high-accuracy gradation printing with a wide range of ink droplet size. A control unit 20 generates: a first contraction signal for contracting the pressure generation chamber 11 without discharging any ink droplet 17; a first expansion signal for expanding the pressure generation chamber 11 to discharge the ink droplet 17; and a second expansion signal to further expand the pressure generation chamber 11 so as to break off an ink column discharged from a nozzle 12 and pull an unnecessary portion of the ink back into the nozzle 12.

16 Claims, 11 Drawing Sheets

INK JET PRINTER AND INK JET PRINTING METHOD

BACKGROUND OF THE INVENTION

1. Field of the Invention

The present invention relates to an ink jet printer and an ink jet type for printing by ink discharged from a nozzle by expanding and shrinking a pressure generation chamber filled with the ink by an electro-mechanic converter consisting of a piezoelectric element or the like. In particular, the present invention relates to an ink jet printer and an ink jet printing method in which the pressure chamber is expanded in a stepped manner so as to discharge fine ink droplets at a high speed, thus improving the image quality, and the pressure chamber is contracted prior to ink discharge so that a wide range of ink droplet size is discharged, realizing a highly accurate gradation printing. The present invention also improve the service life of the electro-mechanic converter such as a piezoelectric element.

2. Description of the Related Art

Conventionally, the ink jet printer has been used as a printing apparatus for recording on a recording paper a data from an electronic processing apparatus such as a computer.

The ink jet printer uses a piezoelectric element or other electro-mechanic converter to expand and contract a pressure generation chamber filled with ink so as to discharge the ink from a nozzle communicating with the pressure generation chamber for printing on a recording paper. Since the ink jet printer can be manufactured with a simple configuration of a small size at reasonable costs, it is widely used for business and private use at home.

In general, a printer is required to have a high quality and high speed printing capability. Especially with the recent spread of personal computers, a high speed and high density recording is strongly desired.

For performing a high-density recording in the ink jet printer, it is necessary to reduce the ink droplet size, for example, by reducing the diameter of the nozzle.

However, a nozzle of a small diameter has difficulty in production as well as has a problem of clogging, deteriorating the reliability. Accordingly, reduction in the nozzle diameter has a limitation.

To cope with this, it has been considered to reduce the ink droplet size by controlling the expansion and contraction speed of the pressure generation chamber.

As is known, in the ink jet printer using a piezoelectric element as an actuator of the pressure generation chamber, a drive voltage signal is applied to deform the piezoelectric element. The drive voltage signal which has been used is a trapezoidal wave as shown in FIG. 14.

As shown in this figure, in a conventional ink jet printer, a drive voltage V1 is increased for time T1 and applied for time T2. This deforms the piezoelectric element to push the wall of the pressure generation chamber.

When the wall is pushed, the pressure generation chamber is contracted to discharge the ink filled inside.

When the drive current is decreased to V0, the piezoelectric element returns to its previous form and the pressure generation chamber returns to its previous volume, so that ink is filled from a common ink tank communicating with the pressure generation chamber.

This contraction and expansion of the pressure generation chamber are repeated to discharge ink for printing a predetermined image or character on a printing paper.

Accordingly, in order to obtain a smaller ink droplet in the ink jet printer using such a trapezoidal drive waveform signal, what can be done is to reduce the drive voltage V1 and the voltage application time T1.

However, in order to set the voltage application time T1 to a smaller value, there arise various problems such as current limit in a circuit, responsibility of the piezoelectric element, resonance, and the like.

Moreover, if the drive voltage V1 is set to a too small value, there arises a non-discharge region where the ink column is not broken.

For this, if only the voltage application time T1 and the drive voltage V1 are simply reduced, the ink droplet diameter and the ink droplet speed are in a region "a" shown in FIG. 15. It is difficult to obtain a droplet smaller than the nozzle diameter.

It should be noted that FIG. 15 show as regions "a" to "f" as the maximum values of the ink droplet speed which can be obtained constantly when driven by various drive methods in the ink jet printer including the conventional technique and present invention which will be detailed later.

Thus, in the ink jet printer, it is difficult to obtain a very small droplet by reducing the drive voltage signal of the conventional trapezoidal waveform and reducing the voltage application time.

To cope with this, there has been suggested a method for modifying the piezoelectric element drive waveform signal to other than trapezoidal for discharging an ink droplet.

For example, Japanese Patent Publication A55-17589 [1] discloses a Pull-Push Method (so-called "hikiuchi" in Japanese), i.e., starting an ink discharge at the moment when the ink meniscus is pulled into the nozzle.

FIG. 16 shows a waveform of the drive signal of this pull-push drive method. Prior to contract the pressure generation chamber to discharge an ink droplet, the pressure generation chamber is once expanded. This brings about two merits.

Firstly, in this pull-push drive, the ink meniscus is pulled into the nozzle when discharge is started. Accordingly, the ink column being discharged is formed more slender than the case of the conventional trapezoidal waveform shown in FIG. 14. This enables to make smaller the ink droplet discharged.

Moreover, in this drive method, even if the voltage is lowered before ink droplet discharge completion so as to take back the ink (expansion of the pressure generation chamber), the ink droplet is broken off from the ink meniscus. Thus, it was possible to reduce the ink droplet size.

Accordingly, when using the drive signal of FIG. 16, it is possible to obtain stable ink discharge even if the voltage application time T3 maintaining the contracted state of the pressure generation chamber at a smaller value than T2.

Thus, by using the drive signal of FIG. 16, it is possible to obtain a smaller ink droplet than when using the trapezoidal wave of FIG. 14 for drive.

On the other hand, Japanese Patent Publication A59-133067 [2] suggests a drive method for applying a voltage signal so as to pull back the ink into the nozzle before the ink droplet discharge is complete.

As shown in FIG. 17, in this drive method, the drive signal is triangular, where the voltage application maintaining time T2 in the conventional drive signal is made zero, so that the ink column during ink discharge is broken earlier.

This makes it possible to obtain a smaller size of ink droplet than when using the trapezoidal wave of FIG. 14 for drive.

Furthermore, Japanese Patent Publication B4-36071 [3] suggests a drive method of rapid meniscus pulling and maintaining the state to discharge a very small droplet.

As shown in FIG. 18, in this drive method, the drive signal has a reversed trapezoidal waveform, wherein the contraction time T4 of the pressure generation chamber is reduced and the bias voltage V2 is increased, so that a protrusion is formed at the center of the meniscus during a contraction maintaining time T5 of the pressure generation chamber.

This protrusion is broken off from the meniscus and becomes an ink droplet. Thus, it is possible to obtain an ink droplet having a diameter smaller than the nozzle diameter.

However, the aforementioned ink jet printers have a problem that it is impossible to-obtain both of the ink droplet size reduction and an appropriate ink droplet speed.

Firstly, in FIG. 16, by using the method disclosed in Citation [1], it was possible to obtain an ink droplet size and ink droplet speed shown by region "b" in FIG. 15. In comparison to the region "a" of the drive method of FIG. 14, it was possible to obtain a smaller ink droplet size at the same speed.

This is because the ink column formed is thinner than in the drive method of FIG. 14 and the force pulling the ink droplet toward the nozzle after discharge becomes smaller.

However, in the drive method of FIG. 16, in order to further reduce the ink droplet size, it is necessary to reduce the voltage V3 to be applied. There arises the same problem as the case of the trapezoidal wave signal shown in FIG. 14, and it is difficult to discharge an ink droplet smaller than the nozzle diameter.

Moreover, in the drive method of Citation [2], it was possible to obtain the ink droplet size and ink droplet speed indicated by region "c" in FIG. 15.

In comparison to the region "a" of the drive method of FIG. 14, it is possible to discharge a smaller ink droplet.

However, in this method, the ink column at the initial stage of the ink discharge is formed by the same phenomenon of the drive method of FIG. 14. Accordingly, like in the case of simple trapezoidal wave, it is impossible to make the head of the ink column smaller than the nozzle diameter. Thus, it is impossible to discharge an ink droplet smaller than the nozzle diameter.

Furthermore, in the drive method of Citation [3], it was possible to obtain the ink droplet size and ink droplet speed shown by region "d" in FIG. 15.

In comparison to the region "a" of the drive method of FIG. 14, it is possible to discharge an ink droplet of sufficiently small size.

However, in this method, it is impossible to obtain a sufficient ink droplet speed because the energy used for the ink droplet discharge is only the ink meniscus restoration force and the ink inertia flow.

That is, in this drive method, it is possible to obtain an almost sufficient result for the ink droplet size reduction, but it is impossible to obtain a sufficient ink droplet discharge speed. When the ink droplet discharge speed is not sufficient, the shooting range of the droplet may be shifted. As a result, it is difficult to perform a clear printing.

Thus, the aforementioned drive methods of the ink jet printer can reduce the ink droplet size but this is accompanied by reduction in the ink droplet speed. As a result, it has been difficult to realize clear printing at a high speed with a very small ink droplet.

SUMMARY OF THE INVENTION

It is therefore an object of the present invention to provide an ink jet printer and ink jet printing method in which a pressure generation chamber is expanded in a stepped manner so as to discharge a fine ink droplet at a high speed, thus improving the image quality, and the pressure generation chamber is contracted prior to ink discharge so that a wide range of ink droplet size can be discharged, enabling a highly accurate gradation printing As well as a prolonged service life of the electro-mechanic converter such as a piezoelectric element.

The ink jet printer according to the invention comprises: a nozzle for discharging ink; a pressure generation chamber communicating with the nozzle; a common ink tank for supplying ink to the pressure generation chamber; a common ink tank for supplying ink to the pressure generation chamber; an electro-mechanic converter connected to at least one wall of the pressure generation chamber; and a control unit for applying a drive voltage signal to the electro-mechanic converter; the electro-mechanic converter being deformed by a drive voltage signal from the control unit, so as to expand or contract the pressure generation chamber to discharge ink from the nozzle, and wherein the control unit generates: a first expansion signal which deforms the electro-mechanic converter so as to expand the pressure generation chamber and maintain the expanded state for a predetermined period of time, so that ink is discharged from the nozzle; and a second expansion signal, following the first expansion signal, which deforms the electro-mechanic converter so as to further expand the pressure generation chamber, so that an ink column discharged from the nozzle is broken off at an early stage and an unnecessary portion of the ink is pulled back into the nozzle.

In the ink jet printer having the aforementioned configuration, the control unit generates a first expansion signal so as to expand the pressure generation chamber via an electro-mechanic converter such as a piezoelectric element and the expanded state is maintained, so that the ink meniscus is abruptly retrieved and vibrated so as to discharge the ink; and generates a second expansion signal so as to further expand the pressure generation chamber, so that an ink column is broken off and an unnecessary portion of the ink is pulled back into the nozzle.

This enables to discharge an ink droplet having a diameter smaller than the nozzle diameter. In comparison to the aforementioned conventional apparatus, the present invention enables to obtain a smaller droplet at a higher speed, thus improving the printing quality.

Especially, the present invention expands the pressure generation chamber in a stepped manner to realize ink droplet discharge and break-off at an early state. In comparison to the apparatus of Citation [3] wherein expansion is performed in a single step, the present invention enables to discharge a smaller ink droplet.

According to another aspect of the present invention, the control unit generates: a first contraction signal to deform the electro-mechanic converter so as to contract the pressure generation chamber without discharging ink from the nozzle; and a first expansion signal to deform the electro-mechanic converter so as to expand the pressure generation chamber and maintain the expanded state for a predetermined period of time, so that ink is discharged from the nozzle.

According to still another aspect of the present invention, the control unit generates: a first contraction signal to deform the electro-mechanic converter so as to contract the pressure generation chamber without discharging ink from the nozzle; a first expansion signal to deform the electro-mechanic converter so as to expand the pressure generation chamber and maintain the expanded state for a predetermined period of time, so that ink is discharged from the nozzle; and a second expansion signal, following the first expansion signal, so as to deform the electro-mechanic converter to further expand the pressure generation chamber, so that an ink column discharged from the nozzle is broken off at an early stage and an unnecessary portion of the ink is pulled back into the nozzle.

In the ink jet printer having the aforementioned configuration, the control unit, before generating the first expansion signal to discharge ink, generates the first contraction signal for contracting the pressure generation changer to a degree not to discharge ink.

This enables, when performing a gradation printing, to obtain a wide range of ink droplet size from a large to very small diameter at a high speed and to drive with a high repetition frequency.

In general, when performing a gradation printing with a high repetition frequency, it is necessary to increase and decrease voltage according to a large, intermediate, and small droplet. Accordingly, bias voltage applied in advance to the piezoelectric element is normally set at a high value and the drive waveform also has a high voltage.

Use of such a high bias voltage and a high drive voltage increases a load on the piezoelectric element, and decrease the service life of the piezoelectric element. This is a disadvantage in the drive circuit cost.

On the other hand, in order to perform a gradation printing with a low drive voltage, it is considered to use a drive waveform constituted by a lower portion than the bias voltage.

In this case when the discharge timings of the large, intermediate, and small droplets are identical, the bias voltage should be decreased to a reference voltage for discharging a large droplet. This requires a long period df time before the discharge timing. On the contrary, when discharging a small droplet, after the discharge, the voltage should increased to the bias voltage and a long period of time is required after the discharge timing.

Accordingly, one ink discharge cycle requires a long period of time, which disables a high speed printing.

According to the present invention, prior to the first expansion signal, the first contraction signal is generated to contract the pressure generation chamber to a degree not to discharge ink. This enables to obtain a large, intermediate, and small droplets at a high speed with a bias voltage and a drive voltage lower than in the conventional apparatus.

Reduction in the bias voltage and drive voltage results in reduction in load to the piezoelectric element and the drive circuit, which is advantageous for the cost.

When the present invention is driven without lowering the bias voltage, it is possible to set a large droplet at a value larger and a small droplet at a value smaller than in the conventional apparatus. This improves the gradation width, enabling printing with a higher accuracy.

Furthermore, because the bias voltage can be set at a low value, it is possible to set one discharge cycle than the aforementioned case, thus enabling to significantly improve the repetition drive frequency.

That is, according to the present invention, with a lower voltage than the conventional drive voltage, it is possible to drive the piezoelectric element within a shorter time. That is, it is possible to obtain a wider gradation drive at a high speed, enabling to perform a high-speed and a high-accuracy printing. Since the drive voltage can be low, it is also possible to improve the service life of the piezoelectric life.

According to yet another aspect of the present invention, the control unit may generate a second contraction signal between the first expansion signal and the second expansion signal, so as to deform the electro-mechanic converter to temporarily contract the pressure generation chamber, thus increasing speed of the ink droplet discharge from the nozzle.

In the ink jet printer having the aforementioned configuration, the control unit generates the second contraction signal after the first expansion signal, so as to temporarily contract the pressure generating chamber.

This pushes in the discharge direction the ink meniscus which is being discharged. Accordingly, the ink discharge speed is further increased. Thus, it is possible to discharge a small droplet at a high speed with a high resolution, thus improving the printing quality.

Here, the second contraction signal may be followed by the second expansion signal immediate after, or after maintaining for a certain time the pressure generation chamber in the contracted state.

According to still yet another aspect of the present invention, the control unit may generate a third contraction signal following the second expansion signal, so as to deform the electro-mechanic converter to contract the pressure generation chamber, so that residual vibration of the ink meniscus in the nozzle is suppressed.

In the ink jet printer having the aforementioned configuration, the control unit generates the third contraction signal after the second expansion signal, so as to contract the pressure generating chamber.

Thus, the residual vibration of the meniscus after an ink droplet discharge can be suppressed at an early stage and accordingly, it is possible to perform drive with a high repetition frequency, enabling to perform printing with a smaller droplet at a high speed and a high resolution. Thus, the printing quality is significantly improved.

The ink jet printing method according to the present invention uses an ink jet printer comprising a nozzle for discharging ink; a pressure generation chamber communicating with the nozzle; a common ink tank for supplying ink to the pressure generation chamber; an electro-mechanic converter connected to at least one wall of the pressure generation chamber; and a control unit for applying a drive voltage signal to the electro-mechanic converter; the electro-mechanic converter being deformed by a drive voltage signal from the control unit, so as to expand or contract the pressure generation chamber, so that ink is discharged from the nozzle, the method comprising: a first expansion step in which the electro-mechanic converter is deformed by a signal from the control unit to expand the pressure generation chamber and maintain the expanded state for a predetermined period of time, so that ink is discharged from the nozzle; and a second expansion step following the first expansion step, wherein the electro-mechanic converter is deformed by a signal from the control unit to further expand the pressure generation chamber, so as to break off an ink column to be discharged from the nozzle at an early stage and pull an unnecessary portion of ink back into the nozzle.

According to another aspect of the present invention, the method may comprise: a first contraction step in which the electro-mechanic converter is deformed by a signal from the control unit to contract the pressure generation chamber without discharging any ink from the nozzle, and a first expansion step following the first contraction step, wherein the electro-mechanic converter is deformed by a signal from the control unit to expand the pressure generation chamber and maintain the expanded state for a predetermined period of time, so as to discharge ink from the nozzle.

According to still another aspect of the present invention, the method may comprise: a first contraction step in which the electro-mechanic converter is deformed by a signal from the control unit to contract the pressure generation chamber without discharging any ink from the nozzle; a first expansion step following the first contraction step, wherein the electro-mechanic converter is deformed by a signal from the control unit to expand the pressure generation chamber and maintain the expanded state for a predetermined period of time, so as to discharge ink from the nozzle; and a second expansion step following the first expansion step, wherein the electro-mechanic converter is deformed by a signal from the control unit to further expand the pressure generation chamber, so as to break off the ink column to be discharged from the nozzle at an early stage and pull an unnecessary portion of the ink back into the nozzle.

According to yet another aspect of the invention, the method may further comprise a second contraction step between the first expansion step and the second expansion step, wherein the electro-mechanic converter is deformed to temporarily contract the pressure generation chamber so as to increase speed of an ink droplet to be discharged from the nozzle.

According to still yet another aspect of the present invention, the method may further comprise a third contraction step following the second expansion step, wherein the electro-mechanic converter is deformed by a signal from the control unit to contract the pressure generation chamber so as to suppress residual vibration of the ink meniscus in the nozzle.

BRIEF DESCRIPTION OF THE DRAWINGS

FIG. 11 shows a drive waveform when gradation printing is performed by the ink jet printer according to the present invention:

DESCRIPTION OF THE PREFERRED EMBODIMENTS

Hereinafter, explanation will be given on a ink jet printer and ink jet printing method according to embodiments of the present invention with reference to the attached drawings.

[Embodiment 1]

Firstly, explanation will be given on an ink jet printer and ink jet printing method according to a first embodiment with reference to FIG. 1 to FIG. 4 and FIG. 15.

Figure 1:
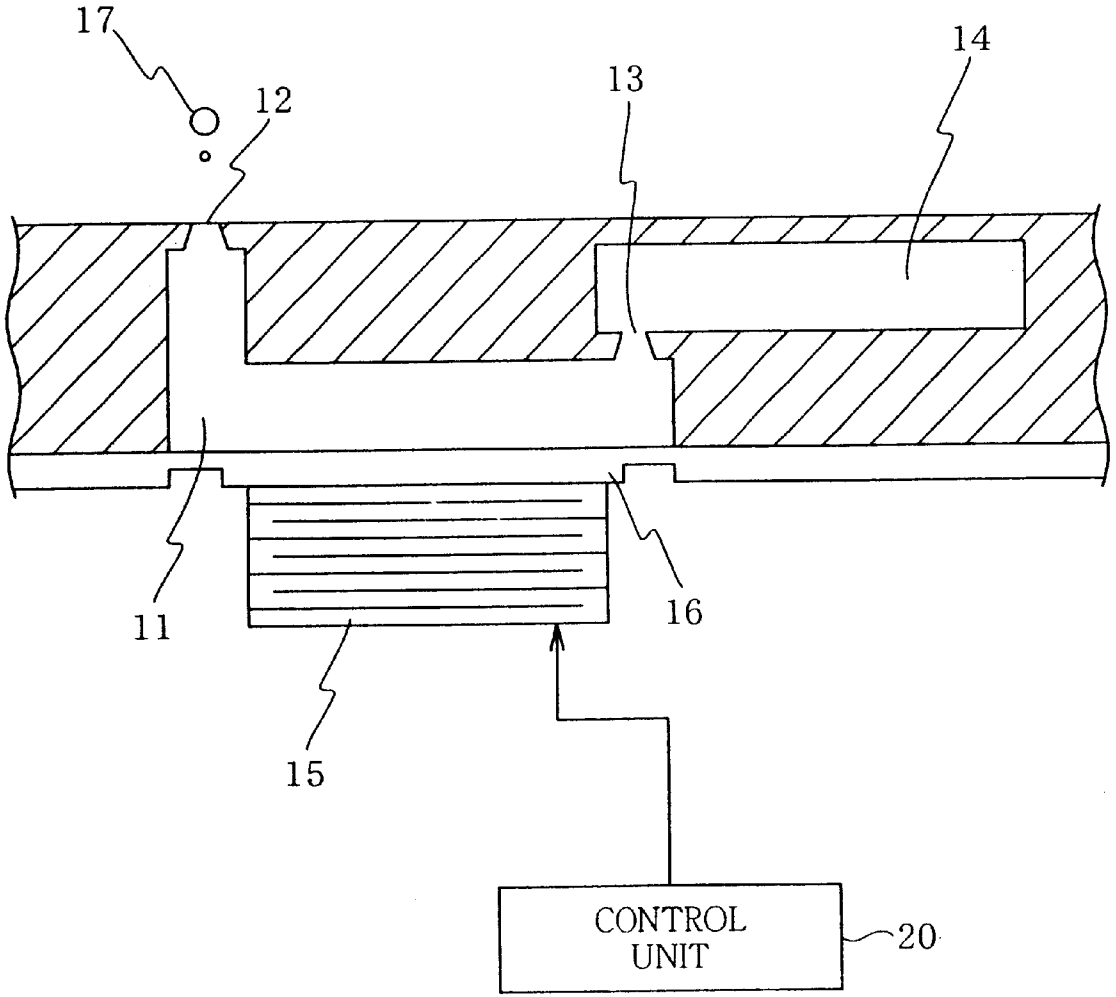
FIG. 1 is a cross sectional view of an essential portion of a printing head of an ink jet printer according to the present invention.

FIG. 1 is a cross sectional view of an essential portion of a printing head of the ink jet printer of the present invention.

Figure 2:
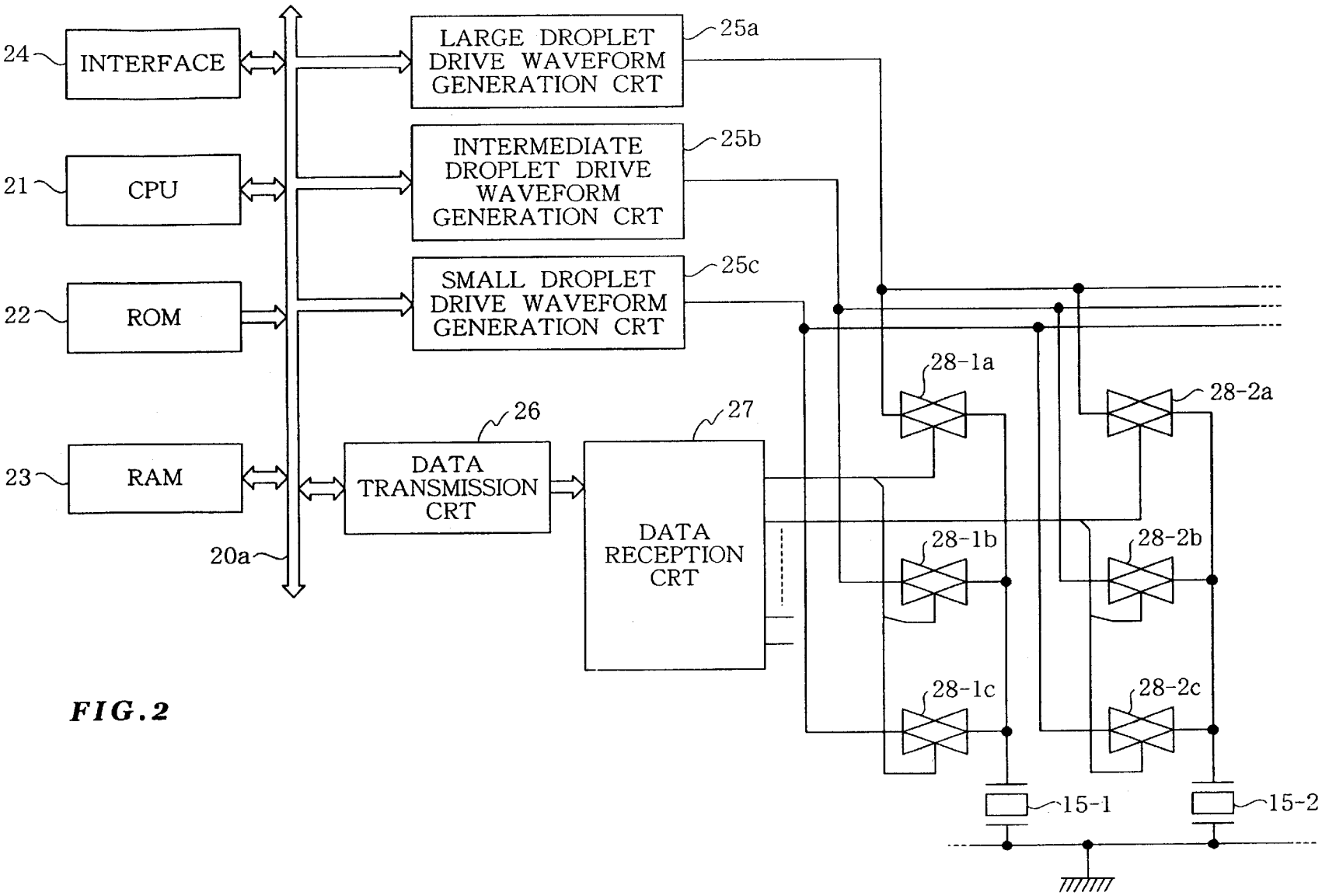
FIG. 2 is a block diagram showing a control unit of an ink jet printer according to a first embodiment of the present invention.

FIG. 2 is a block diagram showing a control unit of the ink jet printer according to a first embodiment.

Figure 3:
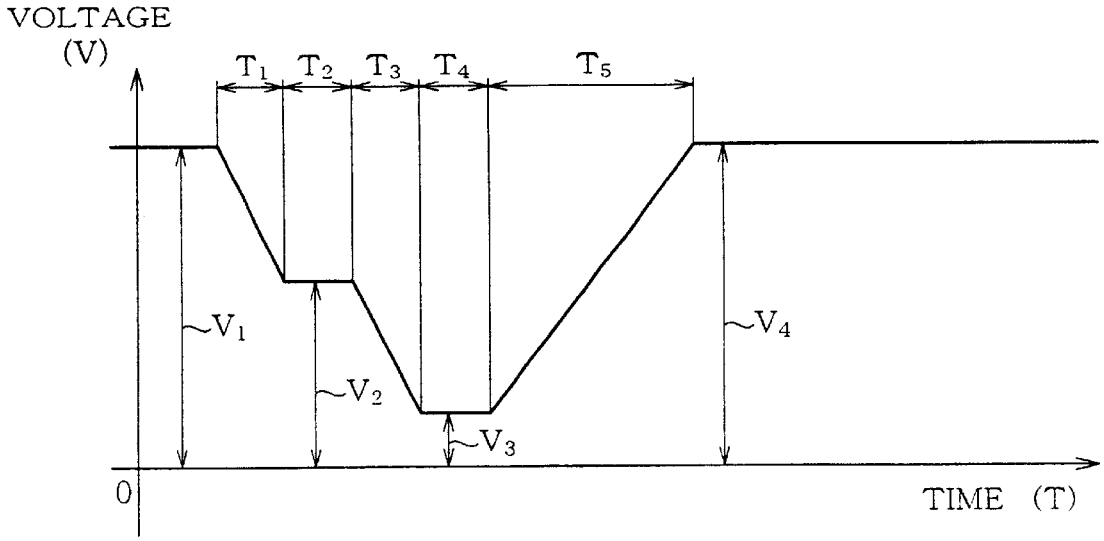
FIG. 3 is a graph showing a drive waveform of the ink jet printer according to the first embodiment of the present invention.

FIG. 3 is a graph showing a drive waveform of the ink jet printer according to the first embodiment.

Figure 4:
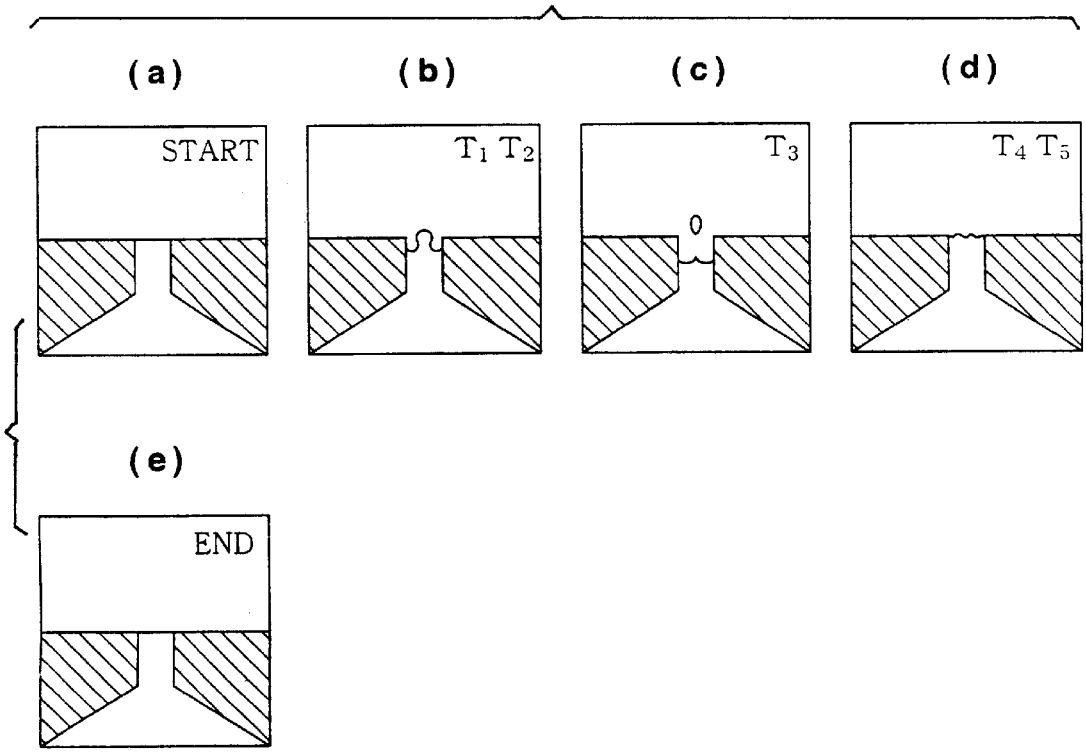
FIG. 4 explains an ink meniscus of the ink jet printer according to the first embodiment of the present invention.

FIG. 4 explains an ink meniscus of the ink jet printer according to the first embodiment.

Figure 15:
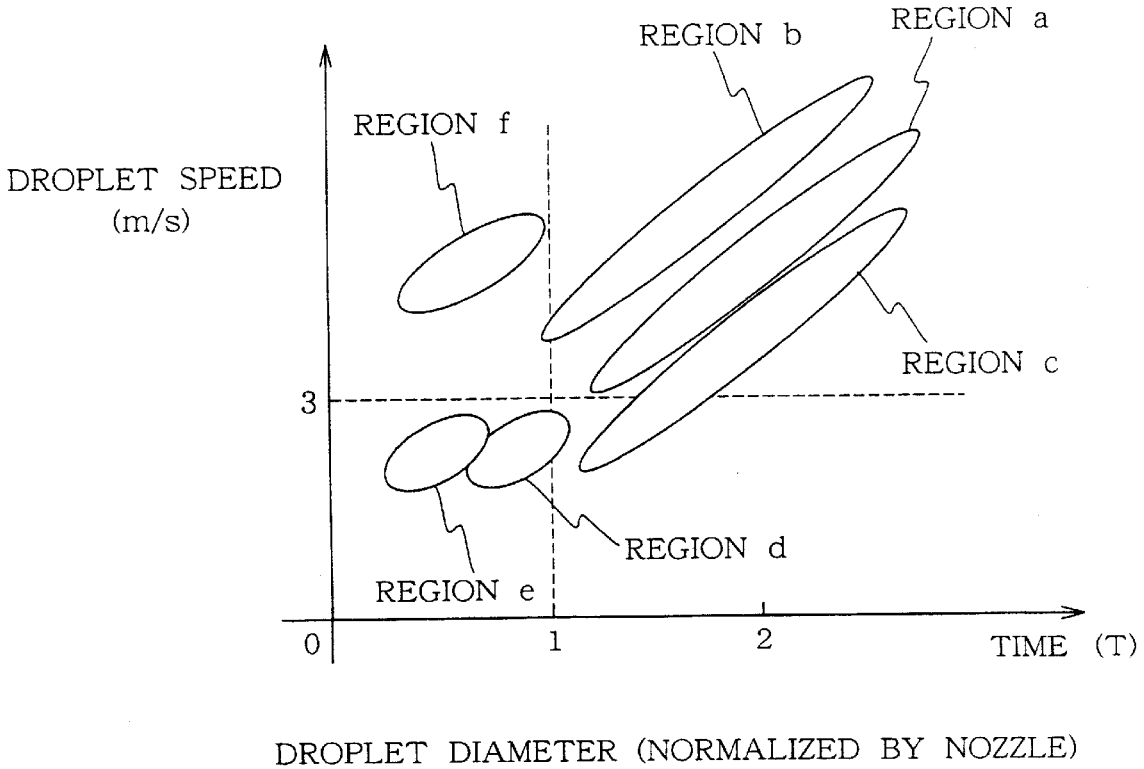
FIG. 15 shows regions of ink droplet diameter and ink droplet speed obtained by different drive methods of the ink jet printer.
Figure 16:
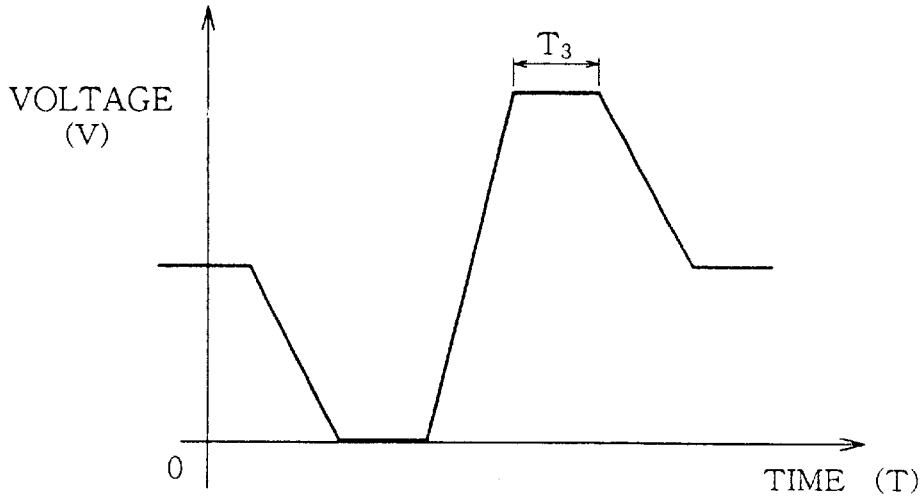
FIG. 16 is a graph showing a drive waveform of another conventional ink jet printer.
Figure 17:
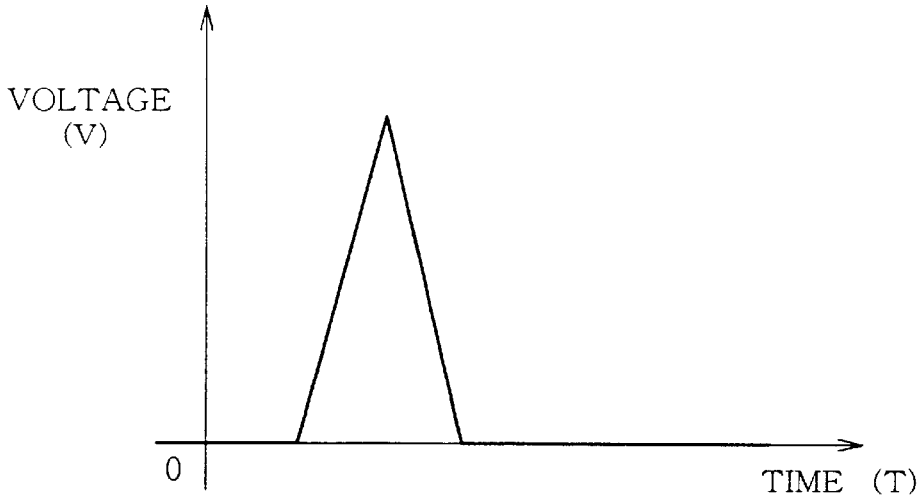
FIG. 17 is a graph showing a drive waveform of still another conventional ink jet printer.
Figure 18:
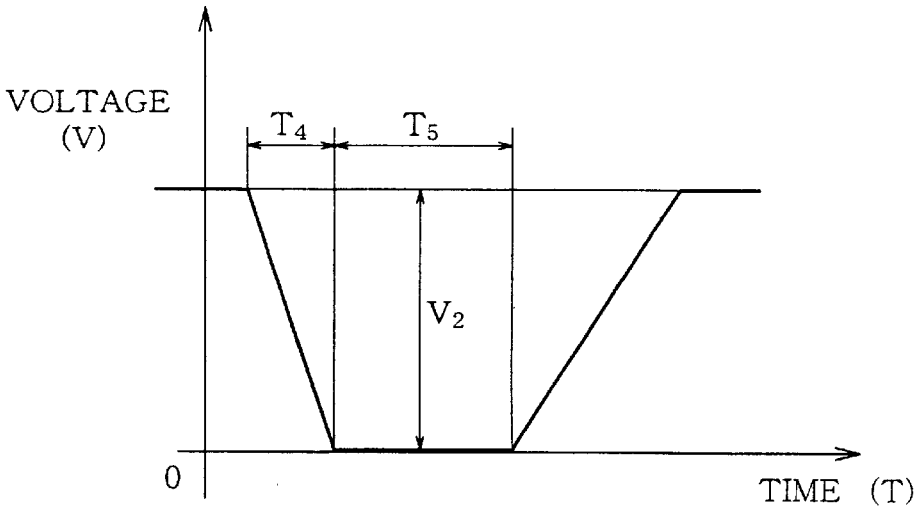
FIG. 18 is a graph showing a drive waveform of yet another conventional ink jet printer.

Moreover, FIG. 15, as has been described above, explains the ink droplet size and ink droplet speed obtained in ink jet printers.

As shown in FIG. 1, the ink jet printer according to the first embodiment includes: a nozzle 12 for discharging ink; a pressure generation chamber 11 communicating with this nozzle 12; and a common ink tank 14 for supplying ink via an ink supply passage 13 to the pressure generation chamber 11. The common ink tank 14, the pressure generation chamber 11, and the nozzle 12 are filled with ink.

The pressure generation chamber 11 has a wall constituted by a diaphragm 16, which is connected to a piezoelectric actuator (piezoelectric element) 15 serving as an electro-mechanic converter for the diaphragm 16.

It should be noted that although not depicted, there are a plurality of nozzles 12 and pressure generation chambers 11, each of which is provided with a diaphragm 16 and a piezoelectric actuator 15.

The piezoelectric actuator 15 is connected to a control unit 20, so that a drive voltage signal is applied from the control unit.

Explanation will be given on the control unit 20 according to the present embodiment with reference to FIG. 2.

FIG. 2 is a block diagram of the control unit 20 of the present embodiment.

As shown here, the control unit 20 includes: a CPU 21 for controlling components of the control unit 20; a ROM 22 containing a routine or the like for various data processing; a RAM 23 for storing various data items; an interface 24 for receiving a printing data from a computer (not depicted); and drive waveform generation circuit 25 (25*a*, 25*b*, 25*c*) for generating a drive waveform signal to the piezoelectric actuator 15. These components are connected to one another through a bus 20*a*.

The drive waveform generation circuit 25 includes a large droplet drive waveform generation circuit 25*a*, an intermediate droplet drive waveform generation circuit 25*b*, and a small droplet drive waveform generation circuit 25*c* for performing gradation printing which will be detailed later.

Drive waveform signals from these drive waveform generation circuits 25*a*, 25*b*, and 25*c* are output via a switch circuit 28 to the piezoelectric actuator 15.

Here, a plurality of piezoelectric actuators 15-1, 15-2, . . . 15-n are arranged corresponding to a plurality of nozzles (not depicted).

Moreover, the switch circuit 28 for outputting a signal to the plurality of piezoelectric actuators 15 includes three switch circuits 28-1*a*, 28-1*b*, 28-1*c*, 28-2*a*, 28-2*b*, 28-2*c*, . . . 28-na, 28-nb, 28-nc corresponding to the three drive waveform generation circuits 25*a*, 25*b*, and 25*c* for each of the piezoelectric actuators 15-1, 15-2, and 15-n.

Moreover, the control unit 20 includes a data transmission circuit 26 and a data reception circuit 27.

The data transmission circuit 26 converts a parallel printing data supplied via the bus 20*a* from the interface 24 and the CPU 21, into a serial printing data and transmits the converted data to the data reception circuit 27.

The data reception circuit 27 decodes the serial printing data from the data transmission circuit 26, so as to control the switch circuits 28.

According to the drive piezoelectric signal from the control unit 20 having the aforementioned configuration, each of the piezoelectric actuators 15 is deformed to push or release the diaphragm 16 to expand or contract the pressure generation chamber 11, so that an ink droplet 17 is discharged from the nozzle 12.

Figure 14:
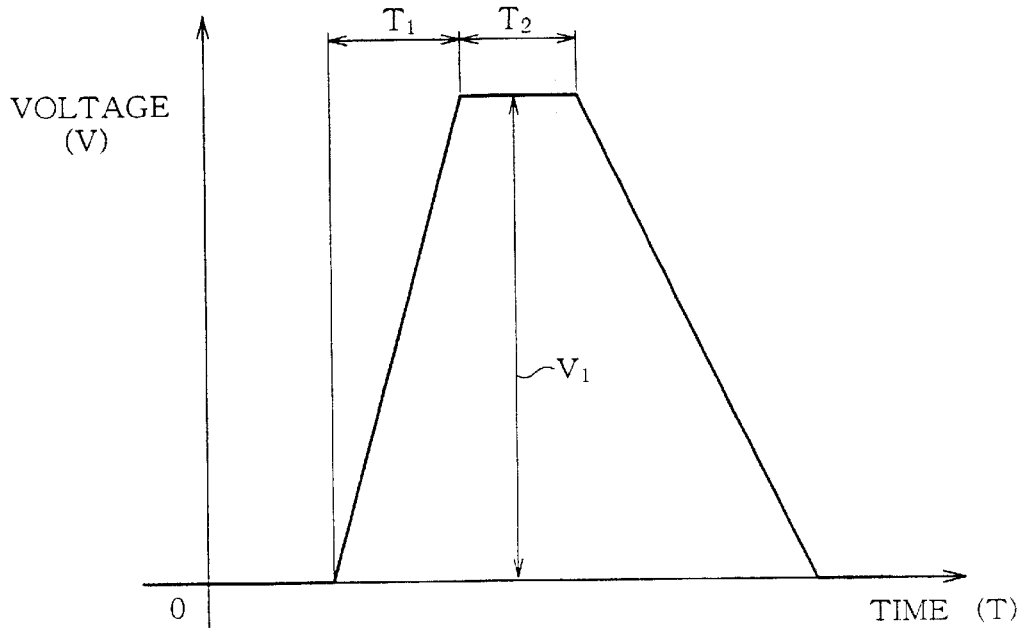
FIG. 14 is a graph showing a drive waveform of a conventional ink jet printer.

In general, in a conventional ink jet printer, regardless of the ink droplet size, the aforementioned drive signal as shown in FIG. 14 is applied to the piezoelectric actuator 15, so that the piezoelectric actuator 15 pushes the diaphragm 16 so as to contract the pressure generation chamber 11 to discharge an ink droplet 17 from the nozzle 12.

On the other hand, in the ink jet printer of the present embodiment, the drive signal is modified according to the size of the ink droplet to be discharged. When a smaller ink droplet is required, the pressure generation chamber 11 is expanded by a drive signal from the control unit 20 and the expanded state is maintained while the ink droplet 17 is discharged from the nozzle 12.

That is, the control unit 20 of the present embodiment generates a first expansion signal for discharging the ink from the nozzle 12 by deforming the piezoelectric actuator 15 to expand the pressure generation chamber 11 and maintaining the expanded state for a predetermined period of time; and a second expansion signal to further deform the piezoelectric actuator 15 to further expand the pressure generation chamber 11 from the first expanded state, so that an ink column discharging the nozzle 12 is broken earlier so as to be discharged from the nozzle 12 and simultaneously with this an unnecessary portion of the ink is pulled back into the nozzle 12.

FIG. 3 shows a drive waveform applied to the piezoelectric actuator 15 from the control unit 20 according to the present embodiment.

Voltage V1 and V4 are bias voltage applied during a repeated discharge or prior to discharge.

The bias voltage V1 and V4 are set to be V1=V4.

Thus, the waveform shown in FIG. 3 is smoothly repeated as one cycle.

Voltage V2 is a first expansion signal for expanding the pressure generation chamber abruptly enough to discharge an ink droplet from the nozzle 12 and maintaining the expansion. The voltage V1 is dropped to voltage V2 for a period of time T1, and this state is maintained for a period of time T2.

This voltage V2 is applied for time T1 and T2, which vibrates the ink meniscus.

Here, the time T1 and T2 are determined by a natural period of an ink jet head flow system. In this embodiment, T1 and T2 are set as follows: T1+T2=½ natural period.

This enables to obtain the maximum effect of the Helmhortz resonance, enabling to discharge an ink droplet at a high speed.

The voltage V2 is followed by voltage V3 which is a second expansion signal for abruptly expanding and maintaining the pressure generation chamber for pulling back an unnecessary portion of ink into the nozzle 12. The voltage V2 is dropped to voltage V3 for a time T3.

This voltage V3 is applied for time T3, which promotes early destruction of the ink column during the ink discharge, enabling to discharge a further smaller droplet.

After an ink droplet is discharged, voltage V4 returns the system to a state prior to printing operation start. The state of voltage V3 is maintained for time T4, the voltage is increased to the bias voltage V4 for time T5.

The signal waveform thus explained constitutes a cycle. During this cycle, ink is discharged from the nozzle 12 and a character or image is recorded on a printing paper (not depicted).

Description will now be directed to operation of the printing method using the aforementioned in jet printer according to the present embodiment with reference to FIG. 3 and FIG. 4.

Firstly, before starting printing, the control unit 20 applies the bias voltage V1 to the piezoelectric actuator 15.

In this condition, the ink meniscus remains flat as shown in FIG. 4A.

Next, the control unit 20 generates the first expansion signal, and in the piezoelectric actuator 15, the voltage V1 is decreased to voltage V2 for time T1 and the V2 is maintained for time T2.

This expands the pressure generation chamber 11 abruptly enough to discharge an ink droplet from the nozzle 12 and while this state is maintained, the ink meniscus is agitated as shown in FIG. 4B.

This first expansion signal is followed by the second expansion signal, and in the piezoelectric actuator 15, the voltage V2 is decreased to voltage V3 for time T3.

This expands the pressure generation chamber 11 for pulling an unnecessary portion of the ink back into the nozzle 12. As shown in FIG. 4C, during ink discharge, the ink column is broken early enough to discharge a small droplet.

After the ink droplet is discharged, the voltage V3 is maintained for time T4, the voltage is increased to the bias voltage V4, taking time T5.

As shown in FIG. 4D, the meniscus vibration is gradually settled, returning back to the state prior to the printing operation start.

The aforementioned waveform constitutes one drive cycle to be repeated and the ink is discharged from the nozzle 12 and printing is performed on a sheet of paper.

Here, the voltage V4 is set identical to the voltage V4, i.e., the state prior to the generation of the first expansion signal. Thus, the drive cycle can be repeated smoothly.

As has been described above, in the ink jet printer according to the present embodiment, the control unit 20 generates the first expansion signal to expand the pressure generation chamber 11 via the piezoelectric actuator 15, which abruptly retrieves the ink meniscus and vibrates the ink meniscus to discharge an ink droplet; and the second expansion signal following immediately after the first expansion signal, so as to further expand the pressure generation chamber 11 to break off the ink column and retrieve an unnecessary portion of the ink back into the nozzle.

This enables to obtain a discharged ink droplet diameter smaller than the nozzle diameter. In FIG. 15, it is possible to realize the region "e" of the ink droplet diameter and the ink droplet discharge speed. That is, in comparison to the conventional apparatus, the present embodiment enables printing with a smaller droplet, thus improving the printing quality.

According to the present invention, the pressure generation chamber 11 is expanded by two steps, enabling to realize an early break off of the ink droplet. This enables to obtain a further smaller droplet than in the apparatus disclosed in Citation [3] in which the pressure generation chamber is expanded by a single step.

EXAMPLE 1

Using the ink jet printer according to the first embodiment of the present invention, we performed a discharge experiment by setting T1=2 microseconds, T2=7 microseconds, T3=2 microseconds, T4=20 microseconds, T5=60 microseconds; and V1=V4=30V, V2=10V, and V3=0V. It has been assured that an ink droplet having a diameter of 8 micrometers is discharged at a speed of 2 m/s by 2 KHz repetition frequency.

On the other hand, we also performed a discharge experiment using the apparatus of Citation [3]. It was impossible to discharge a droplet having a diameter of 10 micrometers or less.

Consequently, the drive waveform of the present embodiment is more advantageous than the conventional drive waveform for obtaining a small droplet.

[Embodiment 2]

Figure 5:
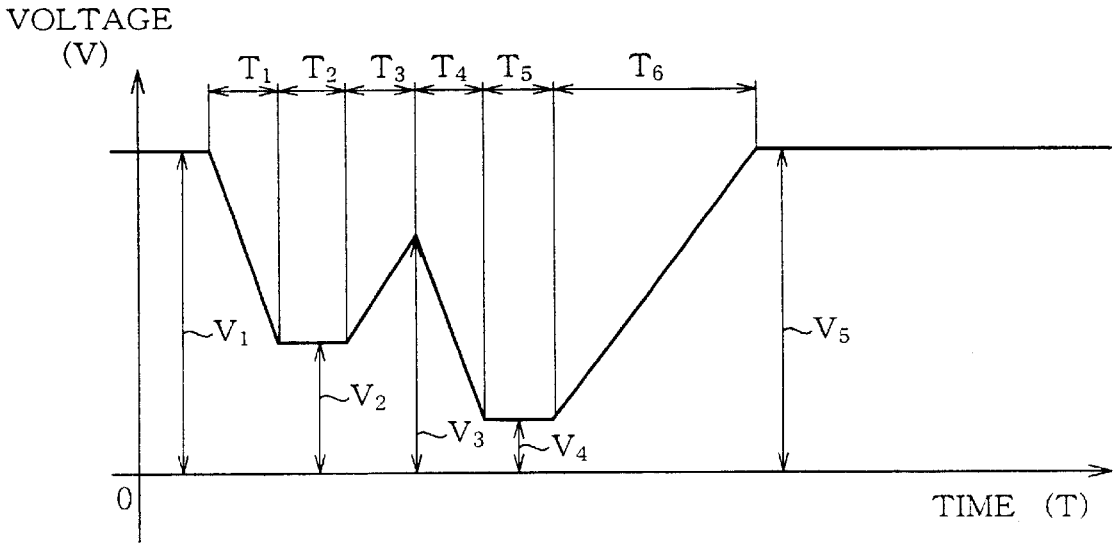
FIG. 5 is a graph showing a drive waveform of an ink jet printer according to a second embodiment of the present invention.
Figure 6:
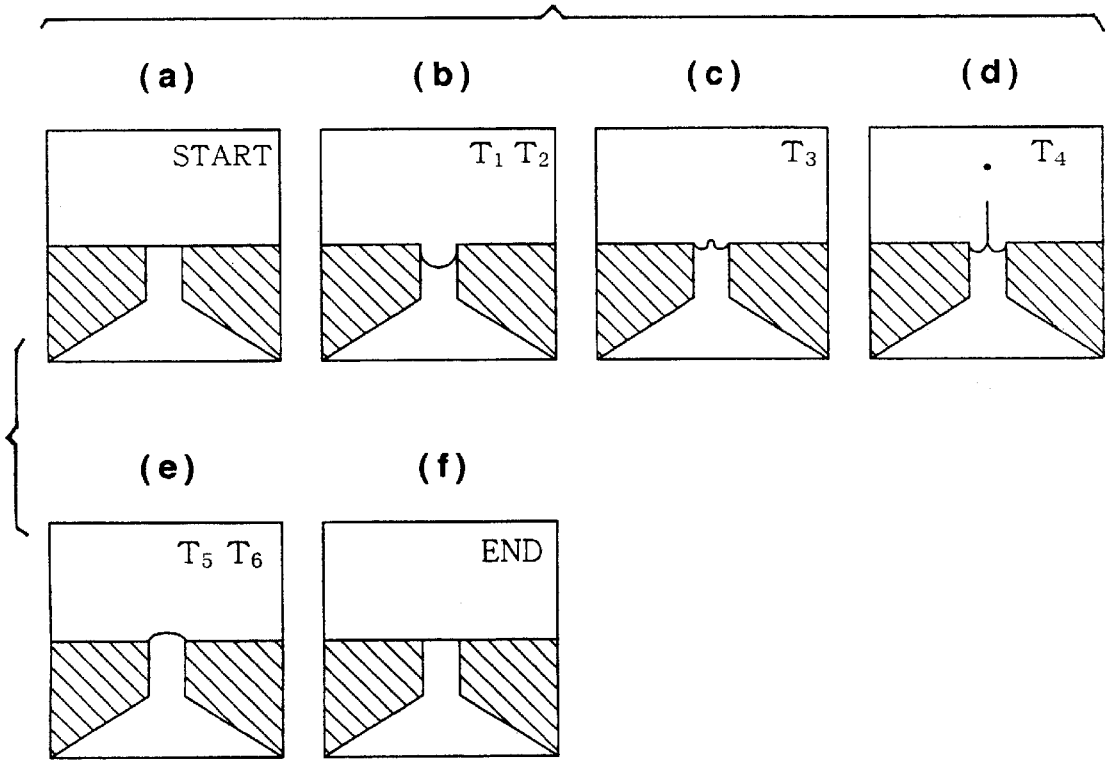
FIG. 6 explains an ink meniscus of the ink jet printer according to the second embodiment of the present invention.

Description will now be directed to an ink jet printer and ink jet printing method according to a second embodiment with reference to FIG. 5, FIG. 6 and FIG. 15.

FIG. 5 is a graph showing a drive waveform of the ink jet printer according to the second embodiment.

FIG. 6 explains ink meniscus in the ink jet printer according to the second embodiment.

As shown in FIG. 5, in this embodiment, a second contraction signal is generated between the first expansion signal and the second expansion signal, so as to deform the piezoelectric actuator 15 to temporarily contract the pressure generation chamber 11, enabling to discharge an ink droplet from nozzle 12 at a high speed.

The other drive method procedure is identical to the aforementioned first embodiment.

Referring to FIG. 5, explanation will be given on the drive waveform applied to the piezoelectric actuator 15 from the control unit 20 of the present embodiment.

Voltage V1 and V5 are bias voltages during a repeated discharge or prior to discharge.

These bias voltages are in the relationship V1=V5.

The waveform shown in FIG. 5 constitutes one cycle which is repeated smoothly.

Voltage V2 is a first expansion signal to expand the pressure generation chamber abruptly enough to discharge an ink droplet from the nozzle 12. Voltage V1 decreased to V2 for a time T1 and the state is maintained for time T2.

The voltage V2 is applied for time T1 and T2, and the ink meniscus is agitated.

The time T1 and T2 are determined by the natural frequency of the flow path of the ink jet head. In this embodiment T1 and T2 are set as follows: T1+T2=½ natural frequency.

This enables to obtain the maximum effect of the Helmhortz resonance and discharge an ink droplet at a high speed.

The voltage V2 is followed by voltage V3, which is a second contraction signal for temporarily contracting the pressure generation chamber. The voltage is increased from voltage V2 to voltage V3 for time T3.

When the voltage V3 is applied, the ink meniscus being discharged is pushed to the discharge direction. This further increases the ink droplet discharge speed.

It should be noted that the time T3 is preferably set as short as possible. Considering the piezoelectric element reliability and the drive circuit electric problems, the time T3 is preferably set to several microseconds.

The voltage V3 is followed by voltage V4, which is a second expansion signal to abruptly expand the pressure generation chamber to pull an unnecessary portion of ink back into the nozzle 12. The voltage V3 is decreased to voltage V4 for time T4.

This voltage V4 is applied for time T4, which promotes early break off of the ink column during ink discharge, enabling to obtain a further smaller droplet.

Here, in order to obtain a very small droplet, it is preferable to set the time T4 to a short time so as not to involve a air bubble, and to set the voltage V4 smaller than V2: V2>V4.

It is worth noting that in the present embodiment, FIG. 5 shows a case that the pressure chamber is contracted by the second contraction signal, and immediately after this, the second expansion signal is generated. However, it is also possible to generate the second expansion signal after maintaining the contracted state of the pressure generation signal by the second contraction signal in a range that it is possible to obtain an effect to reduce the droplet size by the second expansion signal.

After an ink droplet is discharged, the voltage V5 returns the system to a state prior to printing operation start. After the state of voltage V4 is maintained for T5, the voltage is increased to bias voltage V5 for time T6.

The aforementioned signal waveform constitutes one cycle, which is repeatedly driven and the ink is discharged from the nozzle 12 and an image or character is printed on a sheet of paper (not depicted).

Description will now be directed to printing operation using the ink jet printer having the aforementioned configuration according to the present embodiment with reference to FIG. 5 and FIG. 6.

Firstly, before starting printing, the control unit 20 applies a bias voltage Vi to the piezoelectric actuator 15.

In this condition, the ink meniscus is flat as shown in FIG. 6A.

Next, the control unit 20 generates a first expansion signal. In the piezoelectric actuator 15, voltage V1 is decreased to voltage V2 for time T1 and this state is maintained for time T2.

Thus, the pressure generation chamber 11 is abruptly expanded so as to discharge an ink droplet from the nozzle 12, and this state is maintained. Accordingly, the ink meniscus is agitated as shown in FIG. 6B.

This first expansion signal is followed by the second contraction signal. In the piezoelectric actuator 15, voltage V2 is increased to voltage V3 for time T3.

This temporarily contracts the pressure generation chamber 11 and as shown in FIG. 6C, the meniscus discharging an ink droplet is pushed in the discharge direction. Thus, the ink droplet discharge speed is further increased.

This second contraction signal is followed by the second expansion signal, so that in the piezoelectric actuator, voltage V3 is decreased to voltage V4 for time T4.

This abruptly expands the pressure generation chamber 11 so as to pull back into the nozzle 12 an unnecessary portion of the ink from the ink droplet. As shown in FIG. 6D, the early break off of the ink column is promoted during discharge and a very small droplet is discharged.

After the ink droplet is discharged, the voltage V4 state is maintained for time T5, and then the voltage is increased to bias voltage V5 for time T6.

The meniscus vibration is gradually settled as shown in FIG. 6E returns to the state of FIG. 6F before a printing operation.

The aforementioned signal waveform constitutes one cycle, which is repeatedly driven, and the ink is discharged from the nozzle 12 to print a character or image on a sheet of paper.

Here, the voltage V5 is set equal to the bias voltage V1. That is, the system returns to a state before generation of the first expansion signal. Accordingly, the drive is repeated smoothly.

As has been explained above, in the ink jet printer and the ink jet printing method according to the second embodiment, the control unit 20, after the first expansion signal, generates the second contraction signal so as to temporarily contract the pressure generation chamber 11.

This pushes the meniscus which is discharging an ink droplet and the ink droplet discharge speed is further increased, enabling to obtain an ink droplet diameter and an ink droplet speed in a range "f" in FIG. 15. That is, the present embodiment enables to discharge a small ink droplet at a high speed, which in turn enables a printing of a high resolution, further improving the printing quality.

EXAMPLE 2

Using the ink jet printer according to the second embodiment of the present invention, we performed a discharge experiment by setting T1=2 microseconds, T2=4 microseconds, T3=1 microsecond, T4=1 microsecond, T5=20 microseconds, T6=60 microseconds; and V1=V5=30V, V2=10V, V3=20V, and V4=0V. It has been assured that an ink droplet having a diameter of 10 micrometers is discharged at a speed of 5 m/s by 3 KHz repetition frequency.

If this is compared to Example 1, the ink droplet speed can be increased twice or more. Thus, the present embodiment is more advantageous for obtaining a droplet speed than the drive waveform of Example 1.

[Embodiment 3]

Figure 7:
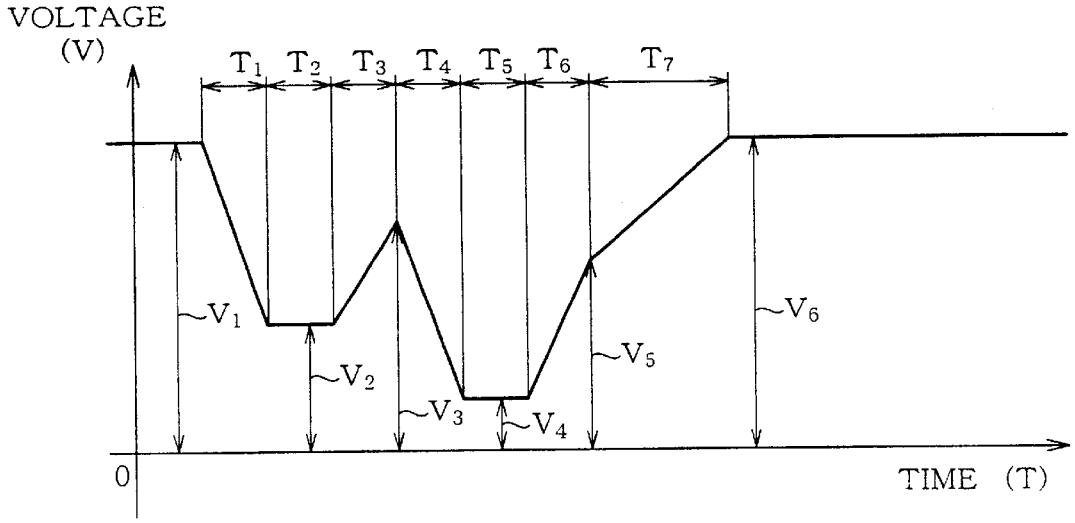
FIG. 7 is a graph showing a drive waveform of an ink jet printer according to a third embodiment of the present invention.
Figure 8:
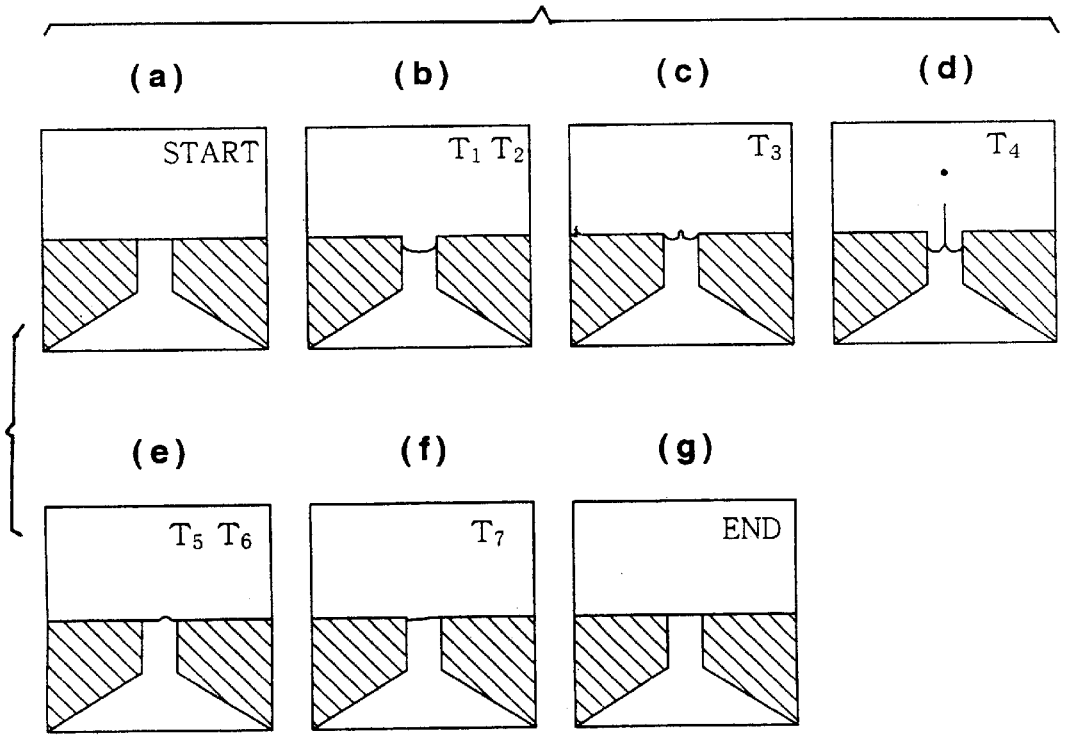
FIG. 8 explains an ink meniscus of the ink jet printer according to the third embodiment of the present invention.

Description will now be directed to an ink jet printer and ink jet printing method according to a third embodiment with reference to FIG. 7 and FIG. 8.

FIG. 7 is a graph showing a drive waveform of the ink jet printer according to the third embodiment of the present invention.

FIG. 8 explains the ink meniscus in the ink jet printer of the third embodiment.

As shown in FIG. 7, in this embodiment, the control unit 20, after generating the second expansion signal, generates a third contraction signal so as to deform the piezoelectric actuator 15 to contract the pressure generation chamber 11, thus suppressing a residual vibration of the ink meniscus in the nozzle 12.

The other portion of the printer components and the drive method is identical as in the first embodiment.

Referring to FIG. 7, explanation will be given on the drive waveform applied to the piezoelectric actuator 15 by the control unit 20 of the present embodiment.

Voltage V1 and V6 are a bias voltage preset beforehand or during a discharge.

The bias voltages V1 and V6 are set equal: V1=V6.

The waveform shown in FIG. 7 constitutes one cycle which is repeated smoothly.

Voltage V2 is a first expansion signal to expand the pressure generation chamber abruptly enough to discharge an ink droplet from the nozzle 12. Voltage V1 decreased to V2 for a time T1 and the state is maintained for time T2.

The voltage V2 is applied for time T1 and T2, and the ink meniscus is agitated.

Here, the time T1 and T2 are determined by the natural frequency of the flow path of the ink jet head. In this embodiment T1 and T2 are set as follows: T1+T2=½ natural frequency.

This enables to obtain the maximum effect of the Helmhortz resonance and a high-speed discharge of an ink droplet.

Voltage V2 is followed by voltage V3, which is a second contraction signal for temporarily contracting and maintaining the pressure generation chamber for increasing the ink droplet discharge speed. The voltage V2 is increased to voltage V3 for a time T3.

This voltage V3 is applied for time T3, which pushes the meniscus in the discharge direction, further increasing the ink droplet discharge speed.

It should be noted that the time T3 is preferably as short as possible. Considering the piezoelectric reliability and electric problems of the drive circuit, the time T3 is preferably set in the order of several microseconds.

Voltage V3 is followed by voltage V4, which is a second expansion signal for abruptly expanding the pressure generation chamber so as to pull back into the nozzle 12 an unnecessary portion of ink from the discharge ink droplet. Voltage V3 is decreased to voltage V4 for time T4.

This voltage V4 applied for time T4 promotes early break off of the ink column during the ink discharge, enabling to discharge a further smaller droplet.

Here, in order to obtain a very small droplet, the time T4 is preferably set small enough not to involve an air bubble. It is preferable that V2>V4.

The voltage V4 is followed by voltage V5, which is a third contraction signal for contracting the pressure generation chamber after the second expansion signal. The voltage V4 state is maintained for time T5 and the voltage is increased up to voltage V5 for time T6.

This voltage V5 is applied for time T6, which suppresses residual vibration of the meniscus after a droplet discharge. Accordingly, it is possible to drive with a high repetition frequency.

Here, the time T5 is preferably set to satisfy the equation T3+T4+T5=½ natural frequency. Time T6 and voltage V5 are preferably set as follows. The time T6 is set as small as possible within a range preventing the ink discharge from the nozzle 12 whereas the voltage V5 is set as large as possible. Thus, it is possible to obtain the maximum effect.

Voltage V6, after discharge of an ink droplet is complete, returns the system to a state prior to printing operation start. The voltage is increased to V6 for time T7.

The aforementioned signal waveform constitutes one cycle, which is repeatedly driven, so that ink is discharged from the nozzle 12 to print a character or image on a sheet of paper.

Description will now be directed to operation of the printing method using the ink jet printer according to the present embodiment with reference to FIG. 7 and FIG. 8.

Firstly, before starting printing, the control unit 20 applies a bias voltage V1 to the piezoelectric actuator 15.

In this condition, the ink meniscus is flat as shown in FIG. 8A.

Next, the control unit 20 generates a first expansion signal. In the piezoelectric actuator 15, voltage V1 is decreased to voltage V2 for time T1 and this state is maintained for time T2.

Thus, the pressure generation chamber 11 is abruptly expanded so as to discharge an ink droplet from the nozzle 12, and this state is maintained. Accordingly, the ink meniscus is agitated as shown in FIG. 8B.

This first expansion signal is followed by the second contraction signal. In the piezoelectric actuator 15, voltage V2 is increased to voltage V3 for time T3.

This temporarily contracts the pressure generation chamber 11 and as shown in FIG. 8C, the meniscus discharging an ink droplet is pushed in the discharge direction. Thus, the ink droplet discharge speed is further increased.

This second contraction signal is followed by the second expansion signal, so that in the piezoelectric actuator 15, voltage V3 is decreased to voltage V4 for time T4.

This abruptly expands the pressure generation chamber 11 so as to pull back an unnecessary portion of the ink from the ink droplet. As shown in FIG. 8D, the early break off of the ink column is promoted during discharge and a very small droplet is discharged.

This second expansion signal is followed by a third contraction signal. In the piezoelectric actuator 15, the voltage V4 state is maintained for time T5 and then increased to voltage V5 for time T6.

Thus, as shown in FIG. 8E, the pressure generation chamber 11 suppresses the residual vibration of the meniscus after ink discharge.

After this, voltage is increased to bias voltage V6 for time T7.

This settles down the meniscus vibration as shown in FIG. 8F and the system returns to the state of FIG. 8G, i.e., the state before starting a printing operation.

The aforementioned signal waveform constitutes one cycle, which is repeatedly driven, and the ink is discharged from the nozzle 12 to print a character or image on a sheet of paper.

Here, the voltage V6 is set equal to the bias voltage V1. That is, the system returns to a state before generation of the first expansion signal. Accordingly, the drive is repeated smoothly.

As has been explained above, in ink jet printer and ink jet printing method according to the third embodiment, the control unit 20, after the second expansion signal, generates the third contraction signal so as to temporarily contract the pressure generation chamber 11.

This suppresses residual vibration of the meniscus at an early stage, facilitating a high-repetition frequency drive, enabling to obtain a small ink droplet diameter and a high ink droplet speed. That is, the present embodiment enables a printing of a high resolution, further improving the printing quality.

EXAMPLE 3

Using the ink jet printer according to the third embodiment of the present invention, we performed a discharge experiment by setting T1=2 microseconds, T2=4 microseconds, T3=1 microsecond, T4=1 microsecond, T5=2 microseconds, T6=2 microseconds, T7=40 microseconds; and V1=V6=30V, V2=10V, V3=20V, V4=0V, and V5=10V. It has been assured that an ink droplet having a diameter of 10 micrometers is discharged at a speed of 5 m/s with 5 KHz repetition frequency.

If this is compared to Example 2, repetition frequency can be almost doubled. Thus, the present embodiment is more advantageous for obtaining a small droplet with a higher repetition frequency than the drive waveform of Example 2.

[Embodiment 4]

Description will now be directed to an ink jet printer and ink jet printing method according to a fourth embodiment with reference to FIG. 9 to FIG. 13.

Figure 9:
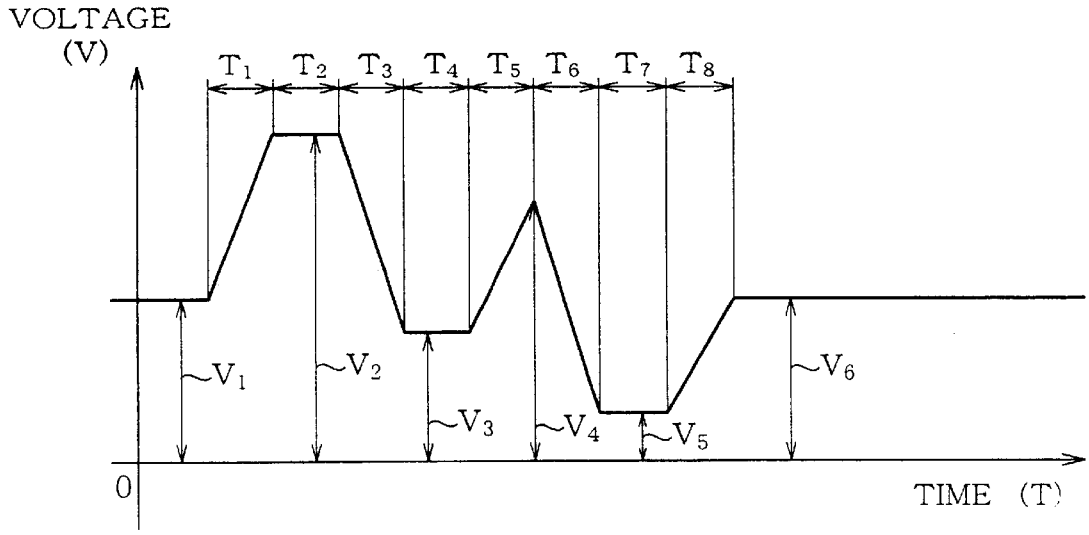
FIG. 9 is a graph showing a drive waveform of an ink jet printer according to a fourth embodiment of the present invention.

FIG. 9 is a graph showing a drive waveform of the ink jet printer according to the fourth embodiment of the present invention.

Figure 10:
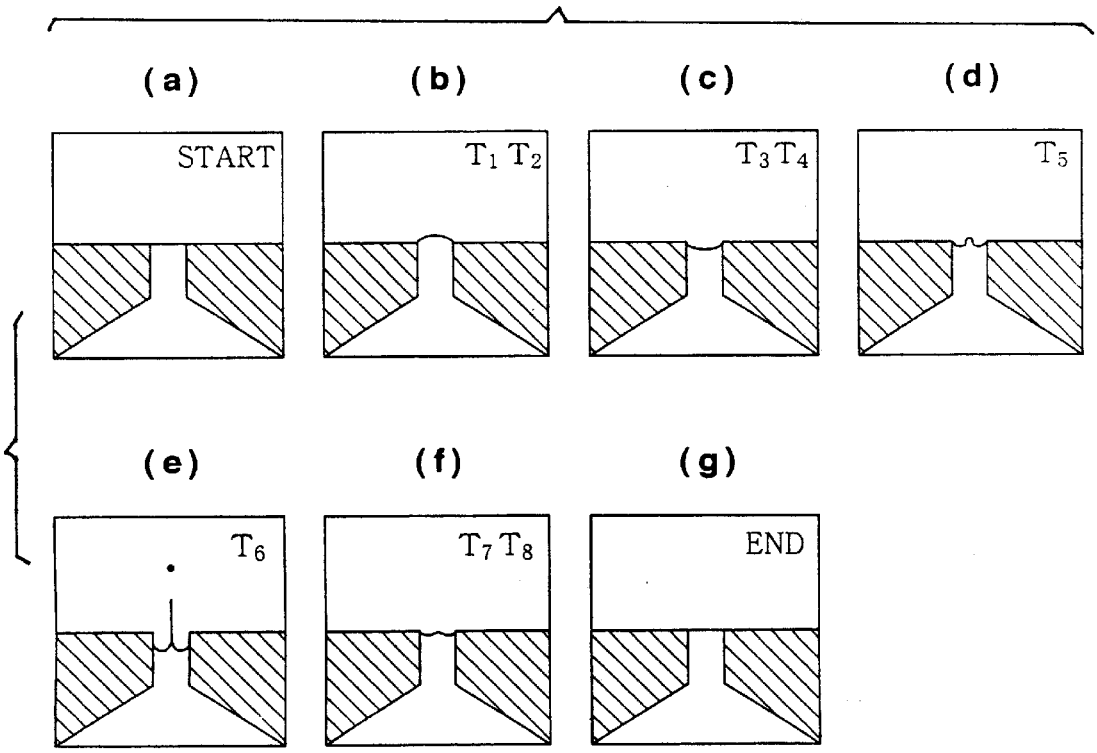
FIG. 10 explains an ink meniscus of the ink jet printer according to the fourth embodiment of the present invention.

FIG. 10 explains the ink meniscus in the ink jet printer of the fourth embodiment.

Figure 11A:
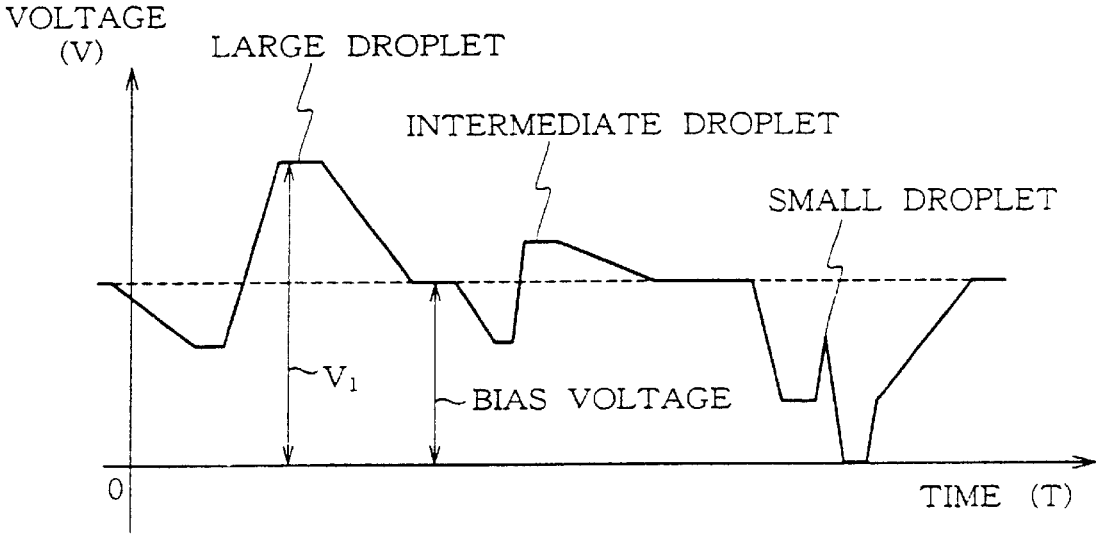
FIG. 11A is a graph obtained by using the apparatuses of other than the fourth embodiment.
Figure 11B:
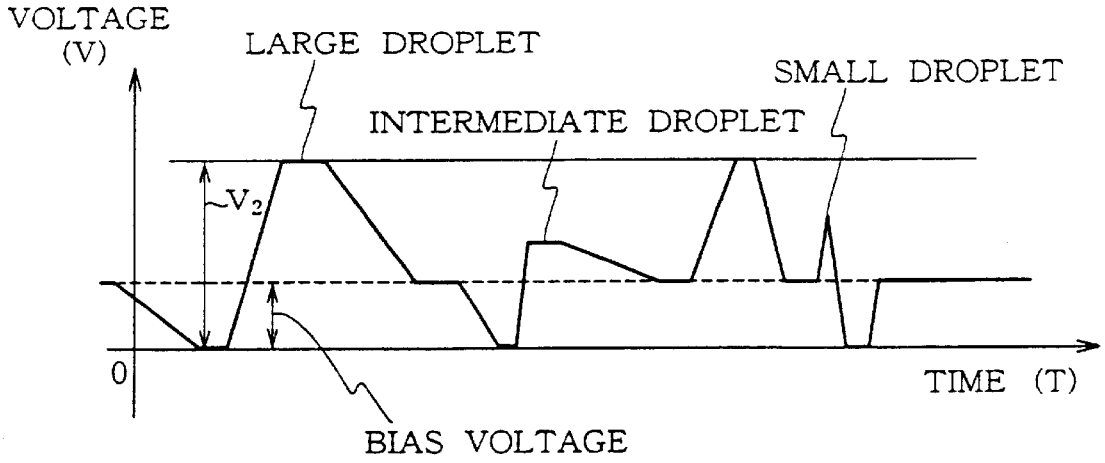
FIG. 11B is a graph obtained by the apparatus according to the fourth embodiment.

FIG. 11 shows a drive waveform when performing a gradation printing using the ink jet printer of the present invention. FIG. 11A shows a case using other than the present embodiment, and FIG. 11B shows a case using the present embodiment.

Figure 12A:
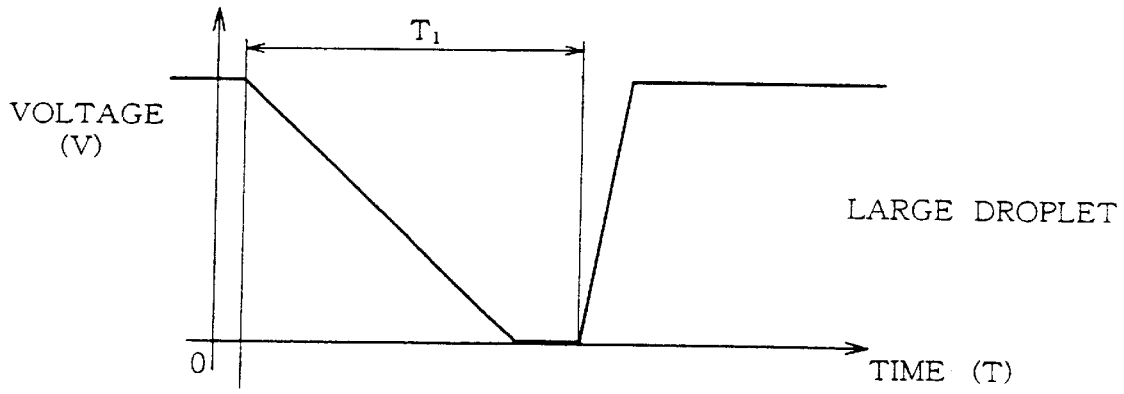
FIG. 12 shows a drive waveform when gradation printing is performed by the ink jet printer according to the present invention, excluding the fourth embodiment.
Figure 12B:
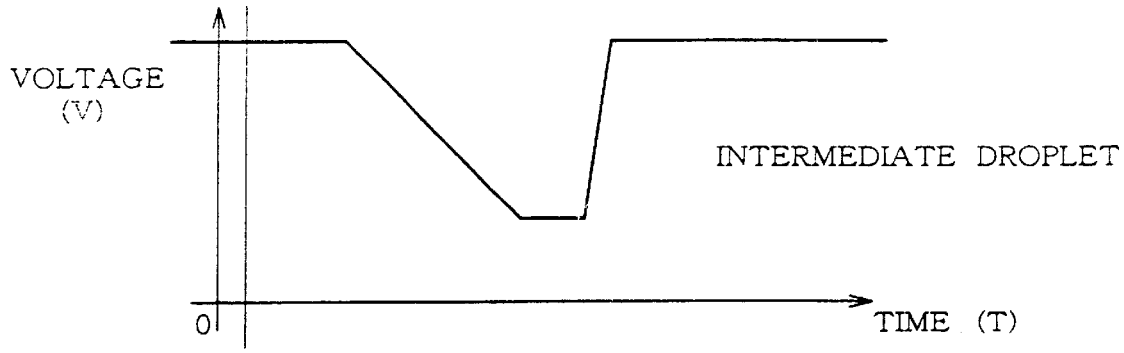
Figure 12C:
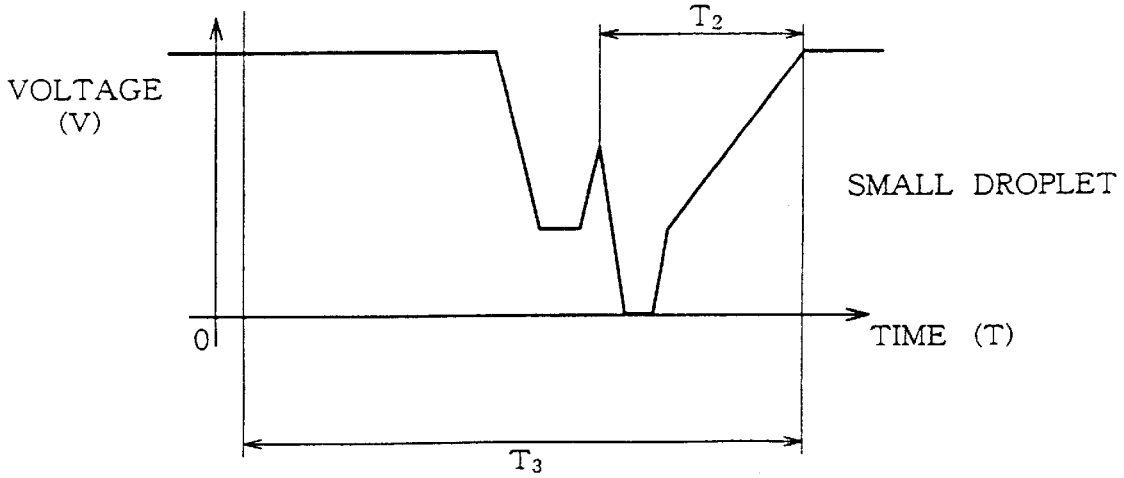
Figure 13A:
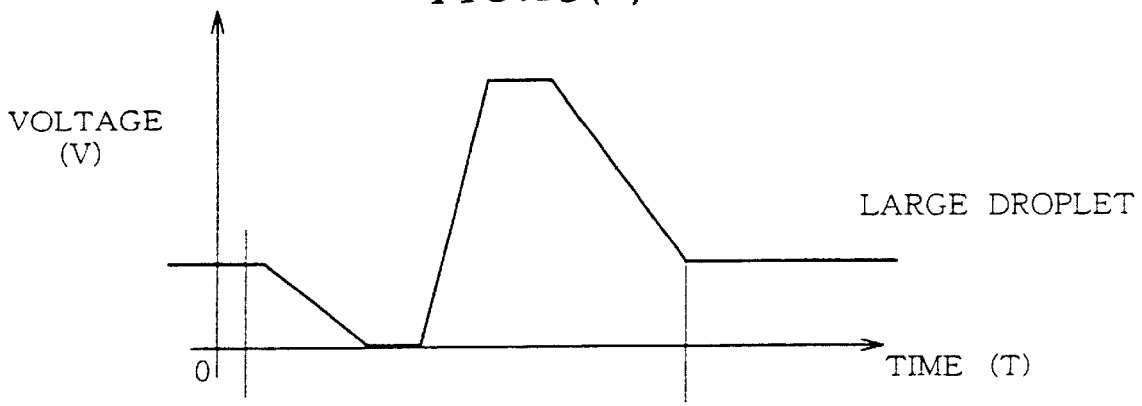
FIG. 13 shows a drive waveform when gradation printing is performed by the ink jet printer according to the fourth embodiment of the present invention.
Figure 13B:
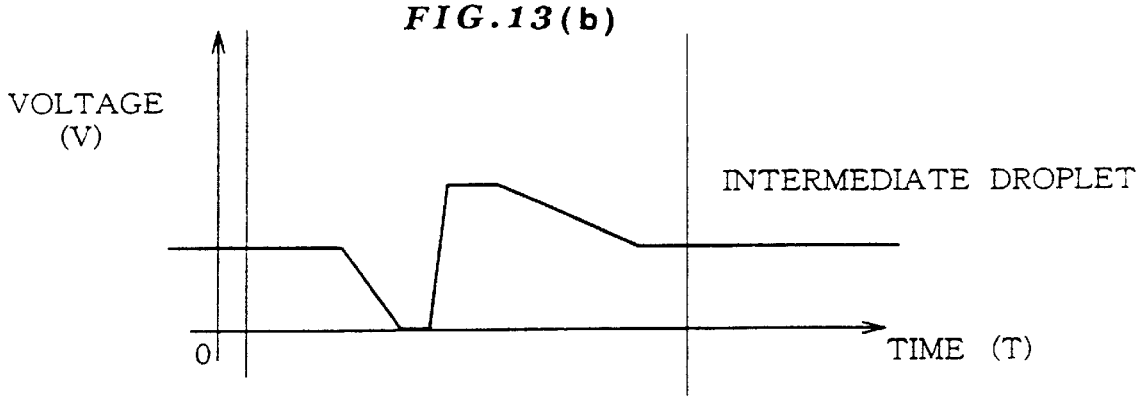
Figure 13C:
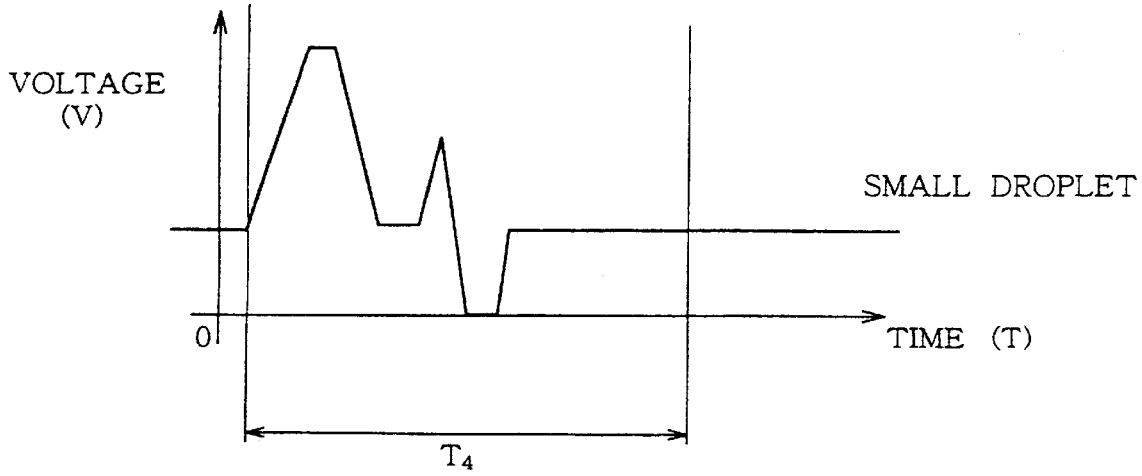

FIG. 12 and FIG. 13 are graphs showing a drive waveform when performing a gradation printing using the ink jet printer according to the present embodiment. FIG. 12 shows a case using embodiments other than the fourth embodiment, and FIG. 13 shows a case using the fourth embodiment.

As shown in FIG. 9, in this embodiment, the control unit 20, prior to generating the first expansion signal, generates a first contraction signal so as to deform the piezoelectric actuator 15 to contract the pressure generation chamber 11.

The other portion of the printer components and the drive method is identical as in the first embodiment.

Referring to FIG. 9, explanation will be given on the drive waveform applied to the piezoelectric actuator 15 by the control unit 20 of the present embodiment.

Voltage V1 and V6 are a bias voltage applied beforehand or during a discharge.

The bias voltages V1 and V6 are set equal: V1=V6.

The waveform shown in FIG. 9 constitutes one cycle which is repeated smoothly.

Voltage V2 is a first contraction signal to contract the pressure generation chamber 11 in such a manner that no ink is discharged from the nozzle 12. Voltage V1 increased to V2 for a time T1 and this state is maintained for time T2.

Thus, by increasing the voltage to V2 for time T1 and T2, a very small ink droplet can be discharged by a low bias voltage V1. As will be detailed later, this also increases the service life of the piezoelectric actuator 15, assures a wide gradation printing with a large droplet to a very small droplet, and enables repeated drive at a high speed.

The voltage V3 is a first expansion signal for abruptly expanding the pressure generation chamber so as to discharge an ink droplet from the nozzle 12. Voltage is decreased from V2 to V3 for time T3 and this state is maintained for time T4.

The voltage V3 is applied for time T3 and T4 so as to agitate the ink meniscus.

Here, the time T3 and T4 are determined by the natural frequency of the flow path of the ink jet head. In this embodiment T3 and T4 are set as follows: T3+T4=½ natural frequency.

This enables to obtain the maximum effect of the Helmhortz resonance and a high-speed discharge of an ink droplet.

Voltage V3 is followed by voltage V4, which is a second contraction signal for temporarily contracting the pressure generation chamber for increasing the ink droplet discharge speed. The voltage is increased from V3 to voltage V4 for time T5.

This voltage V4 is applied for time T3, which pushes the meniscus in the discharge direction, further increasing the ink droplet discharge speed.

It should be noted that the time T5 is preferably as short as possible. Considering the piezoelectric reliability and electric problems of the drive circuit, the time T5 is preferably set in the order of several microseconds.

Voltage V4 is followed by voltage V5, which is a second expansion signal for abruptly expanding the pressure generation chamber so as to pull back into the nozzle 12 an unnecessary portion of ink from the discharge ink droplet. Voltage is decreased from V4 to voltage V5 for time T6.

This voltage V5 applied for time T6 promotes early break off of the ink column during the ink discharge, enabling to discharge a further smaller droplet.

Here, in order to obtain a very small droplet, the time T6 is preferably set small enough not to involve an air bubble. It is preferable that V3>V5.

The voltage V5 is followed by voltage V6, which is a third contraction signal for contracting the pressure generation chamber 11 after the second expansion signal. The voltage V5 state is maintained for time T7 and the voltage is increased up to voltage V6 for time T8.

This voltage V6 is applied for time T8, which suppresses residual vibration of the meniscus after a droplet discharge. Accordingly, it is possible to drive with a high repetition frequency.

Moreover, after the ink droplet discharge, the voltage V6 returns the system to the state before starting a printing operation. Thus, voltage V5 is increased to voltage V6.

The aforementioned signal waveform constitutes one cycle, and this cycle is repeatedly driven, so that ink is discharged from the nozzle 12 for printing on a sheet of paper.

Here, the time T7 is preferably set to satisfy the equation T5+T6+T7=½ natural frequency. Time T8 and voltage V6 are preferably set as follows. The time T8 is set as small as possible within a range preventing ink discharge, whereas the voltage V6 is set as large as possible. Thus, it is possible to obtain the maximum effect.

Description will now be directed to operation of the printing method using the ink jet printer according to the present embodiment with reference to FIG. 9 and FIG. 10.

Firstly, before starting printing, the control unit 20 applies a bias voltage V1 to the piezoelectric actuator 15.

In this condition, the ink meniscus is flat as shown in FIG. 10A.

Next, the control unit 20 generates a first contraction signal. In the piezoelectric actuator 15, voltage V1 is increased to voltage V2 for time T1 and this state is maintained for time T2.

Thus, the pressure generation chamber 11 is contracted in such a manner that no ink is discharged from the nozzle 12.

This first contraction signal is followed by a first expansion signal. In the piezoelectric actuator 15, the voltage V2 is decreased to voltage V3 for time T3, and this state is maintained for time T4.

Thus, the pressure generation chamber 11 is abruptly expanded, so that an ink droplet is discharged from the nozzle 12, and this state is maintained. This agitate the ink meniscus as shown in FIG. 11C.

This first expansion signal is followed by the second contraction signal. In the piezoelectric actuator 15, voltage V3 is increased to voltage V4 for time T5.

This temporarily contracts the pressure generation chamber 11 and as shown in FIG. 10D, the meniscus discharging an ink droplet is pushed in the discharge direction. Thus, the ink droplet discharge speed is further increased.

This second contraction signal is followed by the second expansion signal, so that in the piezoelectric actuator 15, voltage V4 is decreased to voltage V5 for time T3.

This abruptly expands the pressure generation chamber 11 so as to pull back into the nozzle 12 an unnecessary portion of the ink from the ink droplet. As shown in FIG. 10E, the early break off of the ink column is promoted during discharge and a very small droplet is discharged.

This second expansion signal is followed by a third contraction signal. In the piezoelectric actuator 15, the voltage V5 state is maintained for time T7 and then increased to voltage V6 for time T8.

Thus, as shown in FIG. 10F, the pressure generation chamber 11 suppresses the residual vibration of the meniscus after ink discharge. The meniscus vibration is settled as shown in FIG. 10G, and the system returns to the state before starting a printing operation.

The aforementioned signal waveform constitutes one cycle, which is repeatedly driven, and the ink is discharged from the nozzle 12 to print a character or image on a sheet of paper.

Here, the voltage V6 is set equal to the bias voltage V1. That is, the system returns to a state before generation of the first expansion signal. Accordingly, the drive is repeated smoothly.

As has been explained above, in the ink jet printer and the ink jet printing method according to the present embodiment, the control unit 20, before generating the first expansion signal for discharging ink, generates the first contraction signal so as to contract the pressure generation chamber 11 in such a manner that no ink is discharged and to maintain this state.

Thus, even when performing a gradation printing, it is possible to discharge a wide range of size of ink droplets at a high speed with a low voltage and a high repetition frequency.

In general, for performing a gradation printing with a high repetition frequency, it is necessary to increase or decrease the voltage applied, depending on a large, intermediate, and small droplets. Accordingly, it is necessary to use a high drive voltage V1 and a high bias voltage as shown in FIG. 11A.

Such a high bias voltage and drive voltage V1 increase the load on the piezoelectric actuator 15, leading to a short service life and disadvantage in the drive circuit cost.

According to the present embodiment, before ink discharge by the first expansion signal, the first contraction signal is generated to contract the pressure generation chamber in such a manner that no ink is discharged and this state is maintained. Accordingly, as shown in FIG. 11B, it is possible to obtain a large, intermediate, and small droplets with a lower drive voltage V2 and a lower bias voltage than in the case of FIG. 11A.

The reduction of the drive voltage and bias voltage reduces the load on the piezoelectric element and the drive circuit, and brings about advantage in costs.

Moreover, when driving the present invention without decreasing the bias voltage, it is possible to discharge a larger droplet than the aforementioned large droplet and a smaller droplet than the aforementioned small droplet. This significantly improves the gradation width, enabling to obtain a more accurate printing.

Furthermore, when performing a gradation printing with a low drive voltage, as shown in FIG. 12, it is considered to use a drive waveform constituted by a voltage lower than the bias voltage for all of the large, intermediate, and small droplets.

In this case, if the discharge timing is identical for the large, intermediate, and small droplets, as shown in FIG. 12, it is necessary to decrease the bias voltage to a reference voltage for discharging a large ink droplet. That is, a long time T1 is required before the discharge timing. On the contrary, when discharging the small droplet, it is necessary to increase voltage to the bias voltage after the discharge. That is, a long time T2 is required after the discharge timing.

Accordingly, time required for one cycle of ink discharge is the time T3 shown in FIG. 12, disabling to perform a high-speed printing.

On the other hand, in the ink jet printer according to the present embodiment, the pressure generation chamber is contracted to a degree not discharging ink before ink discharge. Accordingly, one discharge cycle generating the first contraction signal can be set at T4 in FIG. 13, i.e., smaller than the case of FIG. 12.

This significantly improves the repetition drive frequency, enabling a high-speed printing.

Thus, using the ink jet printer and the ink jet printing method according to the present embodiment, it is possible to drive the piezoelectric element in a shorter time than in the conventional printer and printing method. This enables to perform a wide gradation drive at a high speed. That is, it becomes possible to perform a high-speed, high-accuracy printing. Moreover, drive can be performed with a low bias voltage, which improves the service life of the piezoelectric element.

EXAMPLE 4

Using the ink jet printer according to the fourth embodiment of the present invention, we performed a discharge experiment by setting T1=50 microseconds, T2=10 microseconds, T3=2 microseconds, T4=4 microseconds, T5=1 microsecond, T6=1 microseconds, T7=2 microseconds, T8=2 microseconds; and V1=V6=10V, V2=30V, V3=10V, V4=20V, and V5=0V. It has been assured that an ink droplet having a diameter of 10 micrometers is discharged at a speed of 5 m/s with 5 KHz repetition frequency.

If this is compared to Example 3, the same ink diameter, ink droplet speed, and repetition frequency can be obtained using a lower bias voltage: 10V in this example compared to 30V in Example 3.

When considering from large to small droplets in gradation printing, the Example 4 shows that drive of a wide gradation width can be performed at a high speed, enabling a high-speed and highly-accurate printing.

It should be noted that the ink jet printer and the ink jet printing method according to the present invention is not to be limited to the aforementioned embodiments, but can be modified in various ways within the scope of the present invention.

For example, in the aforementioned fourth embodiment, the control unit 20 generates a first contraction signal prior to the first expansion signal and the second expansion signal, but the second expansion signal may also be omitted.

As shown in FIG. 11, when discharging a large droplet or an intermediate droplet, i.e., when there is no need of discharging a small droplet, it is possible to omit the second expansion signal for early break up of the ink column and pulling back into the nozzle an unnecessary portion of the ink.

Moreover, in the aforementioned second embodiment, as shown in FIG. 5, the second contraction signal is generated to temporarily contract the pressure generation chamber and then the second expansion is generated. However, it is also possible to insert a drive signal for maintaining the piezoelectric element, between the second contraction signal and the second expansion signal.

Moreover, in the aforementioned embodiments, the piezoelectric actuator is a piezoelectric element utilizing the longitudinal oscillation and longitudinal effect. However, it is also possible to use a piezoelectric element utilizing the longitudinal oscillation and transversal effect. In this case, the drive signal applied to the piezoelectric element may use waveform signals identical to the aforementioned embodiments as they are or reversed or offset in the voltage direction, which can be applied to the ink jet printer.

Moreover, the actuator for expanding and contracting the pressure generation chamber may be other than the piezoelectric element, if a vibrator can expand and contract according to a drive signal, such as a magnetostrictive element.

Furthermore, in the aforementioned embodiments, if a state when no voltage signal is applied is referred to as a stationary state, the pressure generation chamber is expanded and contracted for ink discharge in a region where the volume of the pressure generation chamber is reduced in comparison to the stationary state. However, it is also possible to expand and contract the pressure generation chamber for ink discharge, by using a region to increase the volume of the pressure generation chamber than the stationary state.

As has been described above, in the ink jet printer according to the present invention, the pressure generation chamber is expanded in a stepped manner, enabling to discharge a very small ink droplet at a high speed, thus improving the image quality. Moreover, the pressure generation chamber is contracted before ink discharge, so that a wide range of ink droplet size can be discharged for gradation printing with a high accuracy, and the electromechanical converter such as a piezoelectric element can have a longer service life.

Thus, the present invention enables to obtain an ink droplet smaller than the nozzle diameter discharged at a high speed and that with a high repetition frequency. This significantly improves printing quality.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. A10-334771(Filed on Nov. $25^{th}$, 1998) including specification, claims, drawings and summary are incorporated herein by reference in its entirety.

What is claimed is:

1. An ink jet printer comprising: a nozzle for discharging ink; a pressure generation chamber communicating with the nozzle; a common ink tank for supplying ink to the pressure generation chamber; an electro-mechanic converter connected to at least one wall of the pressure generation chamber; and a control unit for applying a drive voltage signal to the electro-mechanic converter; the electro-mechanic converter being deformed by a drive voltage signal from the control unit, so as to expand or contract the pressure generation chamber to discharge ink from the nozzle, and wherein the control unit generates:

a first expansion signal which deforms the electro-mechanic converter so as to expand the pressure generation chamber and maintain the expanded state for a predetermined period of time, so that ink is discharged from the nozzle; and a second expansion signal, following the first expansion signal, which deforms the electro-mechanic converter so as to further expand the pressure generation chamber, so that an ink column discharged from the nozzle is broken off at an early stage and an unnecessary portion of the ink is pulled back into the nozzle.

2. An ink jet printer as claimed in claim 1, wherein the control unit generates a second contraction signal between the first expansion signal and the second expansion signal, so as to deform the electro-mechanic converter to temporarily contract the pressure generation chamber, thus increasing speed of the ink droplet discharge from the nozzle.

3. An ink jet printer as claimed in claim 2, wherein the control unit generates a third contraction signal following the second expansion signal, so as to deform the electro-mechanic converter to contract the pressure generation chamber, so that residual vibration of the ink meniscus in the nozzle is suppressed.

4. An ink jet printer as claimed in claim 1, wherein the control unit generates a third contraction signal following the second expansion signal, so as to deform the electro-mechanic converter to contract the pressure generation chamber, so that residual vibration of the ink meniscus in the nozzle is suppressed.

5. An ink jet printer comprising: a nozzle for discharging ink; a pressure generation chamber communicating with the nozzle; a common ink tank for supplying ink to the pressure generation chamber; an electro-mechanic converter connected to at least one wall of the pressure generation chamber; and a control unit for applying a drive voltage signal to the electro-mechanic converter; the electro-mechanic converter being deformed by a drive voltage signal from the control unit, so as to expand or contract the pressure generation chamber to discharge ink from the nozzle, and wherein the control unit generates:

a first contraction signal to deform the electro-mechanic converter so as to contract the pressure generation chamber without discharging ink from the nozzle; and a first expansion signal to deform the electro-mechanic converter so as to expand the pressure generation chamber and maintain the expanded state for a predetermined period of time, so that ink is discharged from the nozzle.

6. An ink jet printer comprising: a nozzle for discharging ink; a pressure generation chamber communicating with the nozzle; a common ink tank for supplying ink to the pressure generation chamber; an electro-mechanic converter connected to at least one wall of the pressure generation chamber; and a control unit for applying a drive voltage signal to the electro-mechanic converter; the electro-mechanic converter being deformed by a drive voltage signal from the control unit, so as to expand or contract the pressure generation chamber to discharge ink from the nozzle, and wherein the control unit generates:

a first contraction signal to deform the electro-mechanic converter so as to contract the pressure generation chamber without discharging ink from the nozzle;

a first expansion signal to deform the electro-mechanic converter so as to expand the pressure generation chamber and maintain the expanded state for a predetermined period of time, so that ink is discharged from the nozzle; and a second expansion signal, following the first expansion signal, so as to deform the electro-mechanic converter to further expand the pressure generation chamber, so that an ink column discharged from the nozzle is broken off at an early stage and an unnecessary portion of the ink is pulled back into the nozzle.

7. An ink jet printer as claimed in claim 6, wherein the control unit generates a second contraction signal between the first expansion signal and the second expansion signal, so as to deform the electro-mechanic converter to temporarily contract the pressure generation chamber, thus increasing speed of the ink droplet discharge from the nozzle.

8. An ink jet printer as claimed in claim 6, wherein the control unit generates a third contraction signal following the second expansion signal, so as to deform the electro-mechanic converter to contract the pressure generation chamber, so that residual vibration of the ink meniscus in the nozzle is suppressed.

9. An ink jet printing method using an ink jet printer comprising a nozzle for discharging ink; a pressure generation chamber communicating with the nozzle; a common ink tank for supplying ink to the pressure generation chamber; an electro-mechanic converter connected to at least one wall of the pressure generation chamber; and a control unit for applying a drive voltage signal to the electro-mechanic converter; the electro-mechanic converter being deformed by a drive voltage signal from the control unit, so as to expand or contract the pressure generation chamber, so that ink is discharged from the nozzle, the method comprising:

a first expansion step in which the electro-mechanic converter is deformed by a signal from the control unit to expand the pressure generation chamber and maintain the expanded state for a predetermined period of time, so that ink is discharged from the nozzle, and a second expansion step following the first expansion step, wherein the electro-mechanic converter is deformed by a signal from the control unit to further expand the pressure generation chamber, so as to break off an ink column to be discharged from the nozzle at an early stage and pull an unnecessary portion of ink back into the nozzle.

10. An ink jet printing method as claimed in claim 9, the method further comprising a second contraction step between the first expansion step and the second expansion step, wherein the electro-mechanic converter is deformed to temporarily contract the pressure generation chamber so as to increase speed of an ink droplet to be discharged from the nozzle.

11. An ink jet printing method as claimed in claim 10, the method further comprising a third contraction step following the second expansion step, wherein the electro-mechanic converter is deformed by a signal from the control unit to contract the pressure generation chamber so as to suppress residual vibration of the ink meniscus in the nozzle.

12. An ink jet printing method as claimed in claim 9, the method further comprising a third contraction step following the second expansion step, wherein the electro-mechanic converter is deformed by a signal from the control unit to contract the pressure generation chamber so as to suppress residual vibration of the ink meniscus in the nozzle.

13. An ink jet printing method using an ink jet printer comprising a nozzle for discharging ink; a pressure generation chamber communicating with the nozzle; a common ink tank for supplying ink to the pressure generation chamber; an electro-mechanic converter connected to at least one wall of the pressure generation chamber; and a control unit for applying a drive voltage signal to the electro-mechanic converter; the electro-mechanic converter being deformed by a drive voltage signal from the control unit, so as to expand or contract the pressure generation chamber, so that ink is discharged from the nozzle, the method comprising:

a first contraction step in which the electro-mechanic converter is deformed by a signal from the control unit to contract the pressure generation chamber without discharging any ink from the nozzle, and a first expansion step following the first contraction step, wherein the electro-mechanic converter is deformed by a signal from the control unit to expand the pressure generation chamber and maintain the expanded state for a predetermined period of time, so as to discharge ink from the nozzle.

14. An ink jet printing method using an ink jet printer comprising a nozzle for discharging ink; a pressure generation chamber communicating with the nozzle; a common ink tank for supplying ink to the pressure generation chamber; an electro-mechanic converter connected to at least one wall of the pressure generation chamber; and a control unit for applying a drive voltage signal to the electro-mechanic converter; the electro-mechanic converter being deformed by a drive voltage signal from the control unit, so as to expand or contract the pressure generation chamber, so that ink is discharged from the nozzle, the method comprising:

a first contraction step in which the electro-mechanic converter is deformed by a signal from the control unit to contract the pressure generation chamber without discharging any ink from the nozzle, a first expansion step following the first contraction step, wherein the electro-mechanic converter is deformed by a signal from the control unit to expand the pressure generation chamber and maintain the expanded state for a predetermined period of time, so as to discharge ink from the nozzle, and a second expansion step following the first expansion step, wherein the electro-mechanic converter is deformed by a signal from the control unit to further expand the pressure generation chamber, so as to break off the ink column to be discharged from the nozzle at an early stage and pull an unnecessary portion of the ink back into the nozzle.

15. An ink jet printing method as claimed in claim 14, the method further comprising a second contraction step between the first expansion step and the second expansion step, wherein the electro-mechanic converter is deformed by a signal from the control unit to temporarily contract the pressure generation chamber so as to increase speed of an ink droplet to be discharged from the nozzle.

16. An ink jet printing method as claimed in claim 14, the method further comprising a third contraction step following the second expansion step, wherein the electro-mechanic converter is deformed by a signal from the control unit to contract the pressure generation chamber so as to suppress residual vibration of the ink meniscus in the nozzle.

* * * * *